US005305995A

United States Patent [19]

Nakajima et al.

[11] Patent Number: 5,305,995

[45] Date of Patent: Apr. 26, 1994

[54] SHEET FEEDING APPARATUS FOR RE-FEEDING A SHEET WITHOUT SMEARING

[75] Inventors: Hisao Nakajima, Tokyo; Yasumi Yoshida; Minoru Nada, both of Kawasaki; Noriaki Koyanagi, Kawasaki, all of Japan

[73] Assignee: Canon Kabushiki Kaisha, Tokyo, Japan

[21] Appl. No.: 963,265

[22] Filed: Oct. 19, 1992

Related U.S. Application Data

[63] Continuation of Ser. No. 821,867, Jan. 16, 1992, abandoned, which is a continuation of Ser. No. 628,332, Dec. 17, 1990, abandoned.

[30] Foreign Application Priority Data

| | | | |
|---|---|---|---|
| Dec. 18, 1989 | [JP] | Japan | 1-327819 |
| Dec. 29, 1989 | [JP] | Japan | 1-343865 |
| Jan. 26, 1990 | [JP] | Japan | 2-016585 |
| Feb. 7, 1990 | [JP] | Japan | 2-027761 |

[51] Int. Cl.[5] ..... B65H 3/00

[52] U.S. Cl. ..... 271/18; 271/3.1; 271/37; 271/121

[58] Field of Search ..... 271/3.1, 18, 37, 65, 271/121, 126, 184, 225, 303, 902

[56] References Cited

U.S. PATENT DOCUMENTS

| | | | |
|---|---|---|---|
| 4,019,024 | 4/1977 | Namiki | 219/469 |
| 4,125,362 | 11/1978 | Matsui et al. | 432/60 |
| 4,214,743 | 7/1980 | Meier | 271/184 X |
| 4,254,733 | 3/1981 | Namiki | 118/60 |
| 4,573,789 | 3/1986 | Wada | 355/14 SH |
| 5,008,713 | 4/1991 | Ozawa et al. | 271/3.1 X |

FOREIGN PATENT DOCUMENTS

| | | | |
|---|---|---|---|
| 0303276 | 2/1989 | European Pat. Off. . | |
| 2588537 | 4/1987 | France | 271/121 |
| 153733 | 9/1984 | Japan | 271/121 |
| 1-55577 | 6/1989 | Japan . | |
| 1-156783 | 9/1989 | Japan . | |

OTHER PUBLICATIONS

IBM Technical Disclosure Bulletin, vol. 25, No. 11B, p. 6043 (Apr., 1983).

IBM Technical Disclosure Bulletin, vol. 23, No. 12, p. 5636 (May, 1981).

*Primary Examiner*—D. Glenn Dayoan

*Assistant Examiner*—Boris Milef

*Attorney, Agent, or Firm*—Fitzpatrick, Cella, Harper & Scinto

[57] ABSTRACT

The present invention provides a sheet feeding apparatus which includes a first conveying device for conveying a sheet stack formed in a stepped fashion by offsetting each sheet by a predetermined distance in a predetermined direction toward the predetermined direction or toward an opposite direction, a separating device disposed at a downstream side of the first conveying means in the predetermined direction and adapted to separate an outermost sheet from the sheet stack being fed by the first conveying device, a second conveying device for conveying the sheet separated by the separating device, and control device for controlling the first conveying device in such a manner that the first conveying device is activated to convey the sheet stack in the predetermined direction and the first conveying device is stopped after the sheet separated by the separating device starts to be conveyed by the second conveying device.

28 Claims, 24 Drawing Sheets

SHEET FEEDING APPARATUS FOR RE-FEEDING A SHEET WITHOUT SMEARING

This application is a continuation of application Ser. No. 07/821,867 filed Jan. 16, 1992, now abandoned, which is a continuation of Ser. No. 07/628,332 filed Dec. 17, 1990, now abandoned.

BACKGROUND OF THE INVENTION

1. Field of the Invention

The present invention relates to a sheet feeding apparatus, and more particularly, it relates to a sheet re-feeding mechanism for re-feeding a sheet from an intermediate tray in an image forming system capable of performing a two-sided printing operation and a multi-print operation.

2. Related Background Art

Conventional apparatus, a two-sided image forming system generally includes an intermediate tray for receiving and stacking sheets each having an image printed on a first surface. After the image forming operation regarding first surfaces of the sheets has been completed, the sheets stacked in the intermediate tray are separated and fed one by one to reinsert each sheet into an image forming portion, where an image is printed on a second surface of the sheet. An important matter in performing such a two-sided image forming operation is the reliability of the sheet feeding, i.e., whether the sheet can be fed properly or not. Particularly, the reliability of the sheet re-feeding is important. Whether the sheet having the image printed on its first surface can be accurately separated and individually fed from the intermediate tray is a problem.

FIG. 11 shows an example of a conventional two-sided image forming system.

In FIG. 11, the image forming system includes a body or frame 1, an original support 2 on which an original is rested, a photosensitive drum 3 which can bear an image from the original, mirrors 4, 5, 6, 7 for directing the image on the original to the photosensitive drum 3, a focusing lens 8 for focusing the image on the photosensitive drum, and a transfer electrode 9 for transferring a toner image formed on the photosensitive drum onto a sheet P.

The sheet P stored in a cassette 10 is picked up by a supply roller 11 and is fed out by regist rollers 12 at a predetermined timing synchronous with the image formed on the photosensitive drum 3. After the toner image has been transferred onto the sheet by the transfer electrode 9, the toner image is fixed to the sheet by means of a fixing device 13. When an image is to be superimposed on the first surface of the same sheet P, the sheet P is directed to a sheet feeding path 15 by a switching guide 14 and is then stored in an intermediate tray 16.

On the other hand, when an image is to be formed on a second surface, opposed to the first surface, of the same sheet, the sheet P is directed to a sheet feeding path 17 by the switching guide 14 and is ejected halfway by means of ejector rollers 18. Then, by reversing the ejector rollers 18, a trailing end of the sheet P is introduced into a sheet feeding path 20 by means of a switching guide 19 and then is stored in the intermediate tray 16.

Thereafter, when the image is printed again on the first or second surface of the sheet, the sheet P having the image formed on its first surface is re-fed from the intermediate tray 16 individually and is sent to the image forming portion, where the image is printed on the second surface of the sheet. Now, since the sheet P having the first surface on which the image was formed has been passed through the fixing device 13 to fix the image onto the first surface, the sheets P stacked in the intermediate tray 16 may include the silicone oil adhered on its imaged surface (first surface) or may have a curled end portion formed due to heat and pressure in the fixing device. Thus, there arises a problem that the double feed and/or the jamming of the sheet will occur in the re-feeding of the sheet from the intermediate tray.

FIG. 12 shows an example of a two-sided image forming system designed to enhance such reliability. In this conventional image forming system, whenever the sheet is introduced into the intermediate tray 16, the whole sheet stack is shifted slightly by means of a pair of conveying rollers 21. so that the sheets are stacked in a stepped fashion.

The sheet stack overlapped in such stepped fashion is wholly conveyed toward a pair of rollers 22 after the image forming operation regarding first surfaces of the sheets has been completed. Then, by stopping the activation of the paired conveying rollers 21 immediately after a lowermost sheet P in the sheet stack leaves the paired conveying rollers 21, only the lowermost sheet P pinched between the paired rollers 22 is fed out by such rollers 22 for the second surface printing operation. According to this example, it is possible to improve the prevention of the double-feed of the sheets during the sheet refeeding operation.

Incidentally, in performing the two-sided printing operation, the technique that the sheets each having the image printed on its first surface are stacked in the stepped fashion is disclosed in the Japanese Patent Laid-open No. 58-178373, Japanese Patent Publication No. 63-18744 and the like.

However, in the above conventional example, it is necessary to provide or prepare a condition that only the lowermost sheet P in the sheet stack is pinched by the paired rollers 22 and at the same time is separated from the paired rollers 21, and the remaining sheets are pinched by only the paired rollers 21. To do so, as shown in FIG. 13A, it is necessary to set a distance between the paired rollers 21 and 22 to a length slightly shorter than a length of the sheet P. In this case, although the toner fixed to the sheets does not rub with each other and thus the sheets are not smeared, the sheets P having different sizes cannot be re-fed.

Accordingly, if it is desired to re-feed the sheets P having different sizes, the optimum positional relation between the paired rollers 21 and 22 as shown in FIG. 13A must be satisfied regarding the smallest size sheet P and at the same time a condition as shown in FIG. 13B must be satisfied regarding the larger size sheets. That is to say, only the lowermost sheet to be re-fed is separated from the paired rollers 21 and the remaining sheets are pinched by the paired rollers 21, and at least the lowermost sheet is pinched by the paired rollers 22. Thus, in this case, when the sheets P having the sizes sufficiently larger than the smallest sheet size are fed, two or more sheets including the lowermost sheet are pinched by the paired rollers 22. From this condition, a rubber driving roller 22*b* of the paired rollers 22 shifts the lowermost sheet. The remaining sheets are not shifted since they are pinched by the paired rollers 21.

Consequently, as shown in FIGS. 14 and 15, the lowermost sheet $P_1$ is shifted toward a direction shown by the arrow while slidingly contacting with a second or upper sheet $P_2$. Thus, during the multi-print operation, as shown in FIG. 14, the toner particles on the second sheet $P_2$ in the nip area (between the rollers 22) are transferred onto a hatched area of the lowermost sheet $P_1$ and thus are peeled from the second sheet $P_2$. On the other hand, during the two-sided printing operation, as shown in FIG. 15, the toner particles on the lowermost sheet are transferred onto the second sheet $P_2$ at the nip area, and thus, the toner particles on the hatched area of the lowermost sheet $P_1$ are peeled from the lowermost sheet.

SUMMARY OF THE INVENTION

Accordingly, an object of the present invention is to provide a sheet feeding apparatus which can positively re-feed sheets without smearing the latter by providing a sheet re-feeding means for re-feeding the sheets without frictionally sliding the sheets with respect to each other, regardless of the different sizes of the sheets in a sheet stack formed in a stepped fashion.

According to the present invention, the above object is achieved by providing a sheet feeding apparatus comprising a first conveying means for conveying a sheet stack formed in a stepped fashion by shifting each sheet by a predetermined distance in a predetermined direction toward the predetermined direction or toward an opposite direction, a separating means disposed at a downstream side of the first conveying means in the predetermined direction and adapted to separate a lowermost sheet from the sheet stack being fed by the first conveying means, a second conveying means for conveying the sheet separated by the separating means, and a control means for controlling the first conveying means in such a manner that the first conveying means is activated to convey the sheet stack in the predetermined direction and the first conveying means is stopped after the sheet separated by the separating means starts to be conveyed by the second conveying means.

DETAILED DESCRIPTION OF THE PREFERRED EMBODIMENTS

The present invention will now be explained in connection with embodiments thereof with reference to the accompanying drawings.

Figure 1:
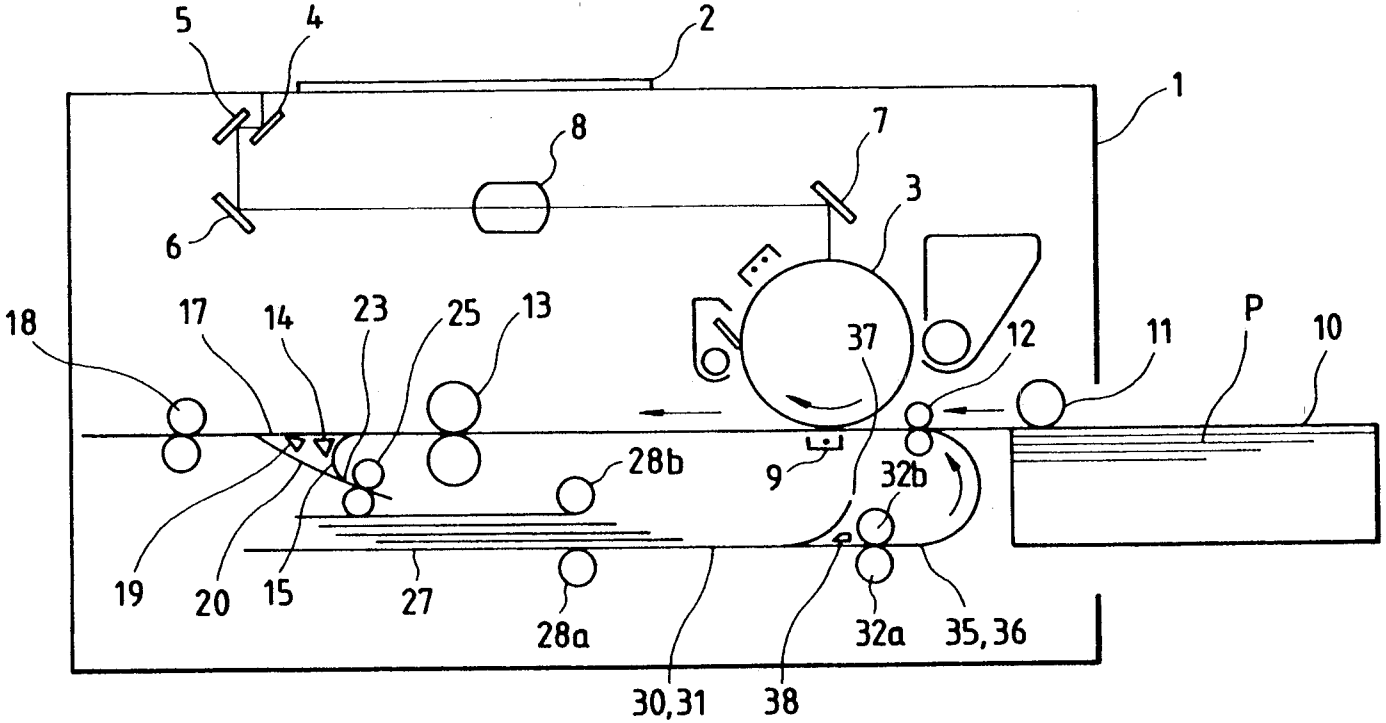
FIG. 1 is an elevational sectional view of a copying machine incorporating a sheet feeding apparatus according to a preferred embodiment of the present invention.

FIG. 1 shows an image forming system incorporating the present invention, which is embodied as a copying machine which can perform the both-surface printing operation and the multi-print operation.

Figure 12:
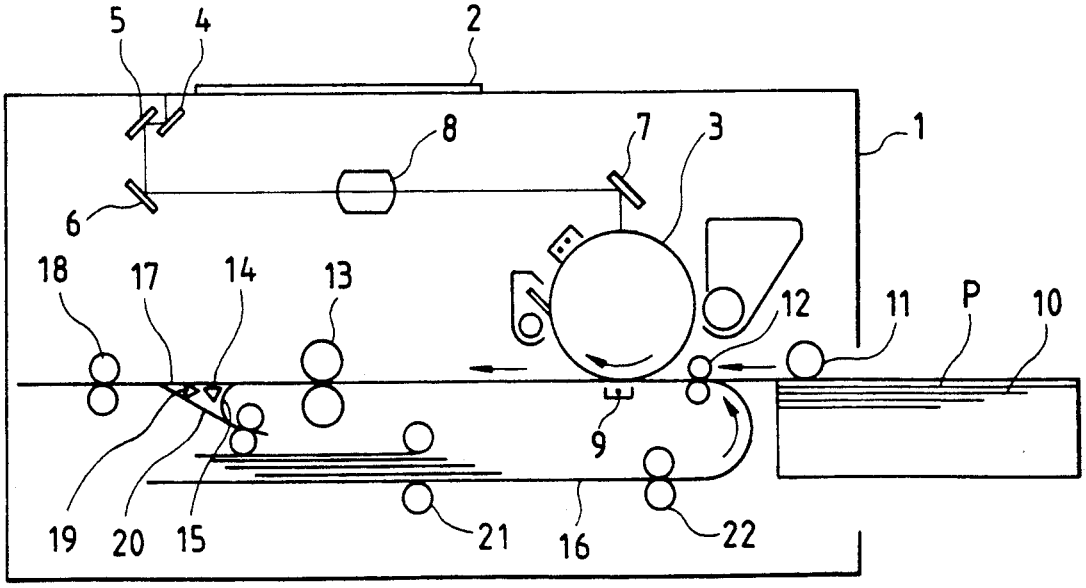
FIG. 12 PRIOR ART
FIG. 12 is an elevational sectional view of another conventional copying machine.
Figure 13A:
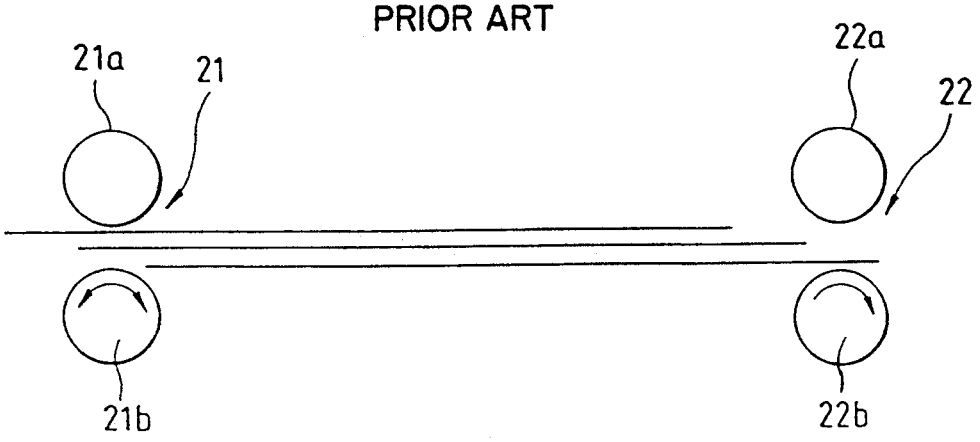
FIG. 13A PRIOR ART
FIG. 13A is an elevational view showing an arrangement of conveying rollers regarding a small size sheet.
Figure 13B:
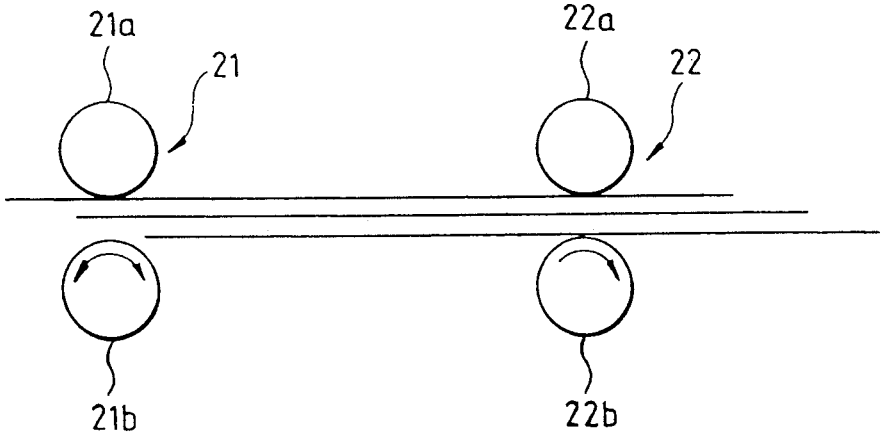
FIG. 13B PRIOR ART
FIG. 13B is an elevational view showing a condition that a longer size sheets are conveyed.
Figure 14:
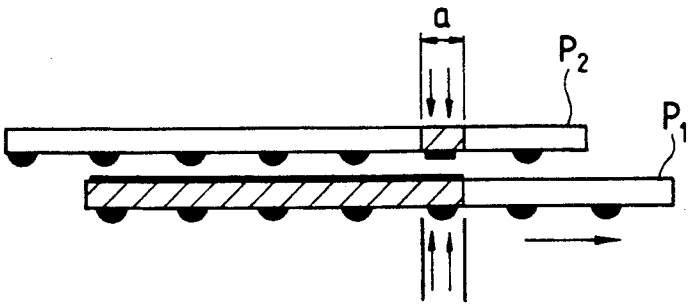
FIGS. 14 and 15 are sectional views for explaining the occurrence of the smudge of the sheet.
Figure 15:
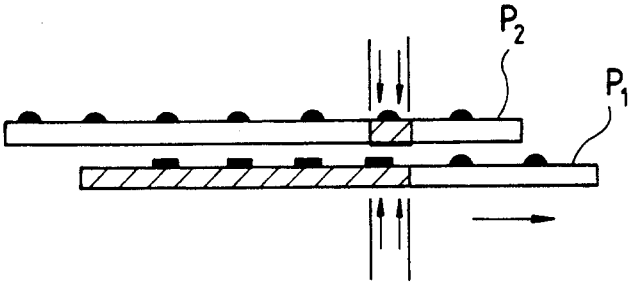

In FIG. 1, structural elements similar to those of the conventional system shown in FIG. 12 are designated by the same reference numerals and the explanation thereof will be omitted. Thus, a section between a sheet feeding path 23 joining sheet feeding paths 15, 20 and regist rollers 12 will now be explained with reference to FIGS. 1 and 2.

A sensor 24 for detecting a leading end of a sheet P is arranged at a downstream side of the sheet feeding path 23 and a pair of conveying rollers 25 are disposed near and at an upstream side of the sensor 24. Further, an upper guide 26 of the sheet feeding path 23 extends rearwardly and downwardly and a lower horizontal guide 27 is arranged below the guide 26 in confronting relation thereto. A driving rubber roller 28*a* is disposed in such a manner that a nip of this driving roller is substantially flush with the lower guide 27. A driven roller 28*b* made of resin material having lower frictional coefficiency than that of rubber material is arranged above the driving roller 28*a* for up-and-down movement and is biased to urge against the driving roller by means of a leaf spring 29.

Upper and lower guides 30 and 31 similar to the upper and lower guides 26, 27 are disposed at the right of the driving and driven rollers 28*a*, 28*b*, and a pair of rollers 32*a*, 32*b* are arranged at the right of the guide 30, 31 in such a manner that a nip between these rollers 32*a*, 32*b* is substantially flush with an upper surface of the lower guide 31. The roller 32*a* is rotatably supported on a fixed shaft (not shown). The roller 32*b* is mounted for up-and-down movement and is biased downwardly to urge against the roller 32*a* by means of a leaf spring 34. At the right of the paired rollers 32*a*, 32*b*, upper and lower guides 35 and 36 are curved upwardly from horizontal positions and are disposed in such a manner that the nip between the rollers 32*a*, 32*b* is substantially flush with an upper surface of the lower guide 36.

Further, at a downstream side of the upper guide 30, a branch guide 37 is branched rearwardly and upwardly from this upper guide 30 near the paired rollers 32*a*, 32*b*, and a separating claw 38 is rotatably supported on a shaft 38*a* at a base end of the branch guide 37.

Figure 3A:
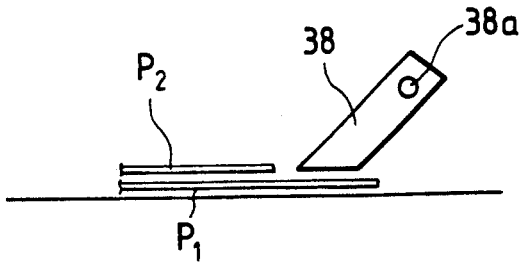
FIGS. 3A to 3E are detailed side views of a separating claw.
Figure 3B:
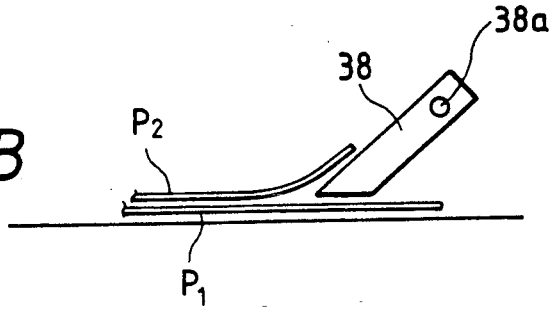
Figure 3C:
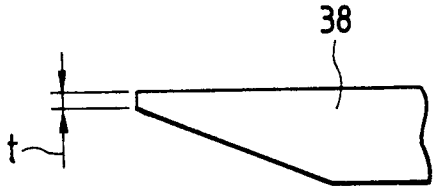
Figure 38:
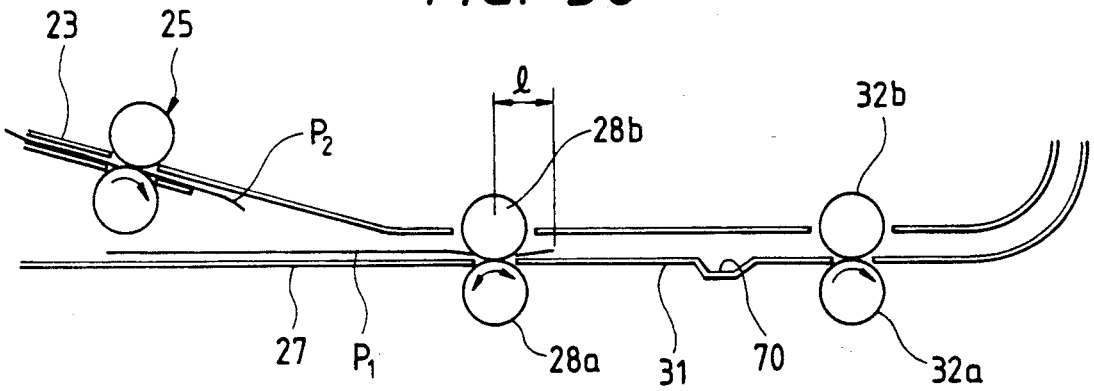

As shown in FIG. 3C, a free pointed end of the separating claw 38 has a thickness t smaller than a thickness of the sheet P being conveyed, and is abutted against a step or shoulder formed between the first sheet $P_1$ and the second sheet $P_2$ when the sheet stack is shifted rightwardly, whereby, as shown in FIG. 38, the first sheet $P_1$ is permitted to be shifted rightwardly, but the second sheet $P_2$ is separated upwardly from the first sheet. Further, a sensor 39 for detecting the sheet P is attached to the lower guide 31.

A driving roller of the paired rollers 25, roller 28*a* and roller 32*a* are connected to respective stepping motors 25*m*, 28*m* and 32*m* through corresponding gear trains (not shown), respectively, and signalling circuits of the stepping motors 25*m*, 28*m*, 32*m*, are connected to a controlling portion 33 so that these stepping motors can be rotated normally or reversely by predetermined angles. Further, the separating claw 38 is connected to a solenoid 38*s*, and a signalling circuit for the solenoid is connected to the controlling portion 33.

Incidentally, the rollers 28*a*, 32*a* are made of rubber material having high coefficient of friction, and the rollers 28*b*, 32*b* are made of resin material and the like having low coefficient of friction (good slidability).

The reference numeral 40 denotes a keyboard for inputting the command regarding the number of copies, two-sided printing mode, multi-print mode, copy start or the like; and 41 denotes a size detection device. Signalling circuits of these elements 40, 41 are connected to the controlling portion 33.

Next, the operation of the copying machine according to this embodiment will be explained.

Figure 4:
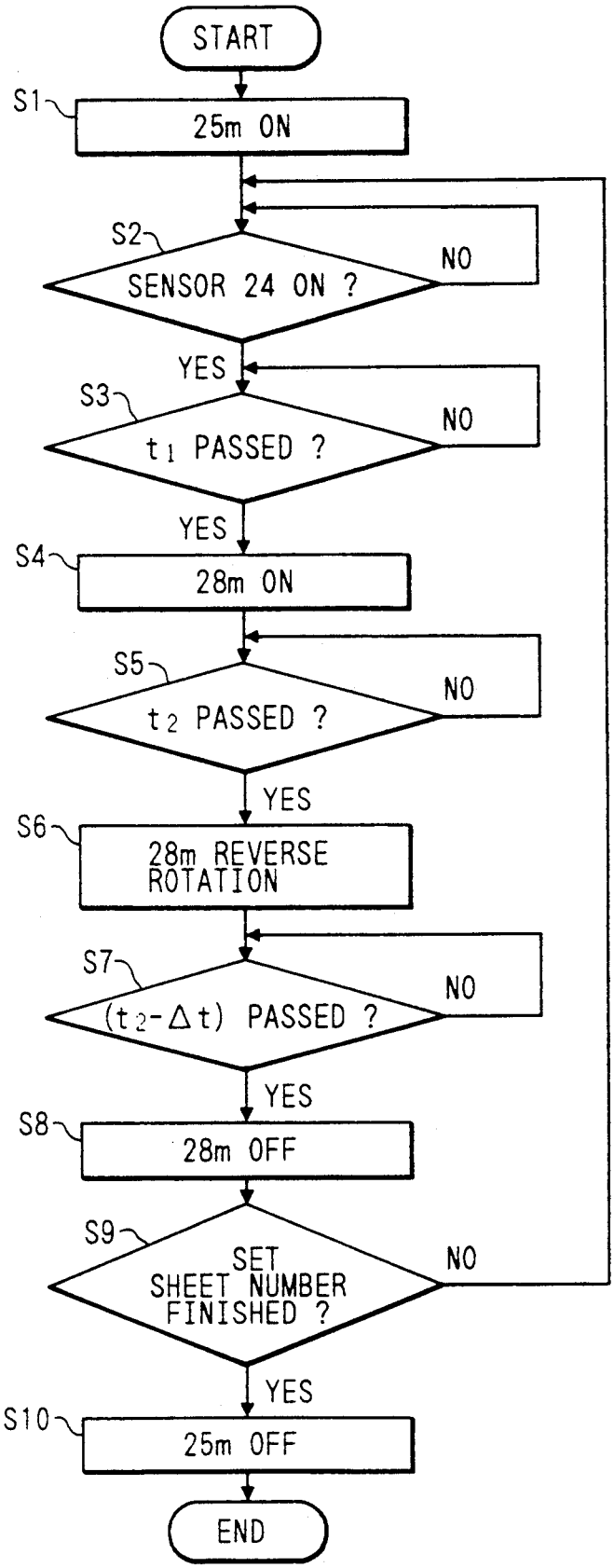
FIG. 4 is a flow chart for stacking sheets.

First of all, a sequence for stacking a plurality of sheets on the lower guide (re-feeding path) 27 will be described with reference to a flow chart of FIG. 4.

Figure 5:
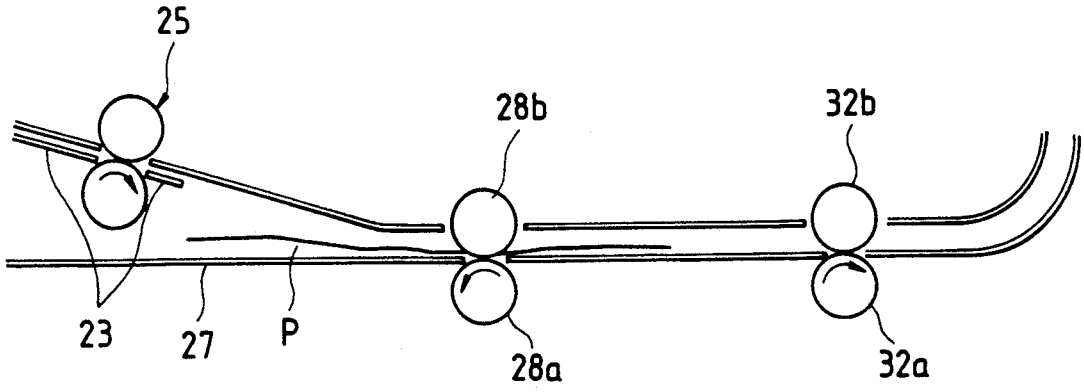
FIGS. 5, 6 and 7 are elevational sectional views of the sheet feeding apparatus showing successive sheet stacking conditions.
Figure 6:
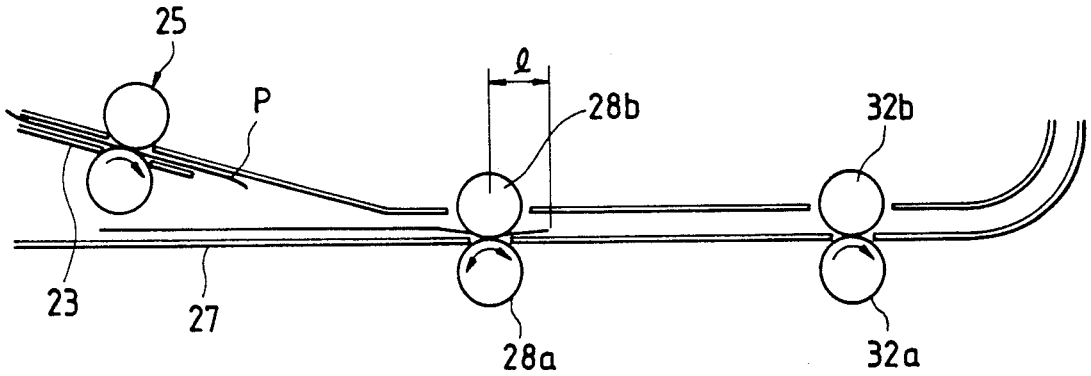

When the two-sided printing mode or the multi-print mode is selected and the copy start is commanded through the keyboard 40, the sheet P which was picked up from the cassette 10 and on (a first surface of) which the image was formed as mentioned above is sent to the roller 25 starting its rotation in a step S1. From when a leading end of the sheet P is detected by the sensor 24 (step S2), after a predetermined time period $t_1$ required for bringing the leading end of the sheet to the nip between the rollers 28*a*, 28*b* to form a loop in the sheet and to correct the skew-feed of the sheet has been elapsed (step S3), the motor 28*m* is turned ON (step S4). To draw out a trailing end of the sheet from the paired rollers 25 and the guide 23, the motor 28*m* is rotated for a predetermined time period $t_2$ required for conveying the sheet by a pre-selected distance $l_0$ from a condition that the sheet is pinched by the paired rollers 28*a*, 28*b* (FIG. 5). After the time period t has been elapsed (step S5), the motor 28*m* is reversed (step S6). The reverse rotation of the motor 28*m* is stopped (step S8) after a predetermined time period $(t_2-\Delta t)$ shorter than the time period $t_2$ has been elapsed (step S7). During the reverse rotation of the motor 28*m*, the sheet P is conveyed in the reverse direction by means of the paired rollers 28*a*, 28*b* so that the leading end of the sheet P is positioned at a predetermined distance l from the nip between the paired rollers 28*a*, 28*b* in a downstream direction (FIG. 6). During this movement, the trailing end of the sheet reaches below the paired rollers 25 while being guided on the lower guide 27.

Incidentally, the rotation of the paired rollers 28*a*, 28*b* may be controlled by the number of pulses sent from the controlling portion 33 to the motor 28*m*. That is to say, after the leading end of the sheet reaches the nip between the paired rollers 28*a*, 28*b*, by sending the number of pulses corresponding to the rotation angle required to convey the sheet P by the predetermined distance, the paired rollers 28*a*, 28*b* can be controlled.

Then, in a step S9, it is judged whether a set number of sheets have been stacked or not. If not, the sequence returns to the step S2 and a next sheet is conveyed. When the next sheet reaches the paired rollers 28*a*, 28*b*, these rollers are operated in the same manner as mentioned above, while pinching the first sheet P, with the result that a leading end of the next or second sheet P is positioned at the distance l from the nip between the rollers 28*a*, 28*b* in the downstream direction. In this case, the first sheet P is conveyed together with the second sheet P and the leading end of the first sheet is positioned at the distance l from the leading end of the second sheet in the downstream direction.

Figure 7:
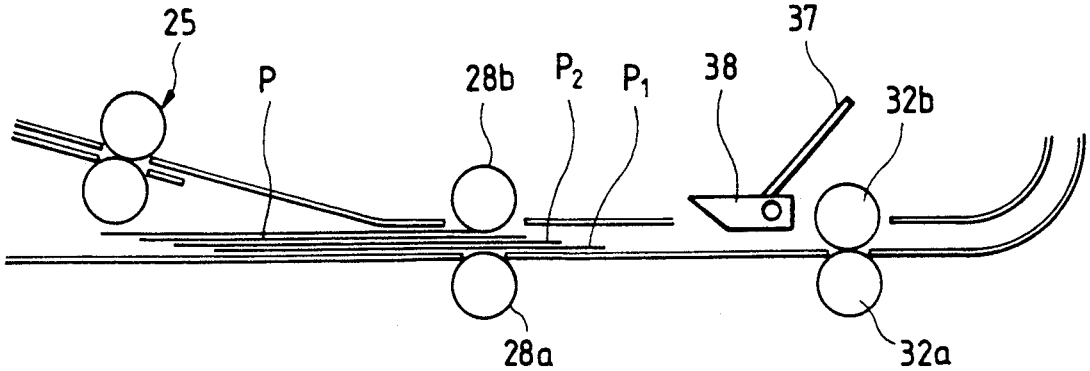

In this way, two sheets are overlapped with offsetting by the distance l. By repeating such operations for the set or necessary number of sheets P, the sheets can be overlapped with offsetting by the distance l, respectively, as shown in FIG. 7. Thereafter, the motor 25*m* is stopped (step S10).

In such operation, when the sheet P is abutted against the paired rollers 28*a*, 28*b*, since only the roller 28*b* made of resin material having good slidability protrudes in the sheet feeding path, the leading end of the sheet P can be smoothly introduced into the nip between the paired rollers 28*a*, 28*b*.

Next, a sequence for re-feeding the stacked sheets for a second image forming operation in the two-sided printing mode or the multi-print mode will be described with reference to a flow chart of FIG. 8.

Figure 9:
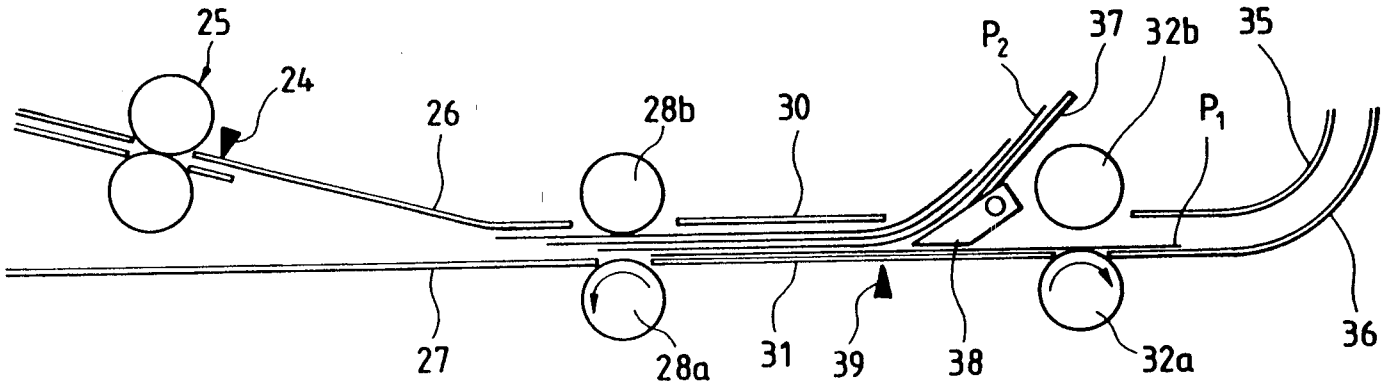
FIG. 9 is an elevational sectional view of the sheet feeding apparatus showing a condition that a first sheet is separated at a branching portion.

When the start is commanded through the keyboard 40, the motors 28*m* and 32*m* start to be rotated (steps S11, S12) and the stacked sheets P are sent to the paired rollers 32*a*, 32*b*. In this case, from when the leading end of the lowermost sheet P is detected by the sensor 39 (step S13), after a predetermined time period $t_3$ has been elapsed, the separating claw 38 is activated (step S15) to move from a waiting position shown in FIG. 7 to an operating position shown in FIG. 9 so that the stacked sheets P other than the lowermost sheet P can be introduced into the branch guide 37. Now, a time period $t_4$ is so selected that, when the separating claw 38 moves to the position of FIG. 9, the free end of the claw abuts against a surface of the lowermost sheet at a upstream side of the leading end of the lowermost sheet $P_1$ and at a downstream side of the leading end of the next or second sheet $P_2$.

After the trailing end of the lowermost sheet $P_1$ has passed through the paired rollers 28*a*, 28*b*, the motor 28*m* is reversed (step S17) to shift the stacked sheets P other than the lowermost sheet P in a reverse direction and only the lowermost sheet $P_1$ is conveyed in the normal direction. In this case, since only the lowermost sheet $P_1$ is pinched by the paired rollers 32*a*, 32*b*, the lowermost sheet cannot be subject to the rubbing action by other sheets $P_2$ and the like in the nip area of the rollers 32*a*, 32*b*. After a predetermined time period $t_5$ from the initiation of the reverse rotation of the motor 28*m* has been elapsed (step S18), the motor 28*m* is stopped (step S19).

The motor 32*m* is stopped (step S21) when a time period $t_6$ required for bringing the lowermost sheet $P_1$ to a next pair of rollers is elapsed (step S20).

The time periods $t_3$, $t_4$, $t_5$ and $t_6$ are selected in accordance with the size of the sheet P, distances between the rollers and diameters of the rollers, and are stored in the controlling portion 33. The controlling portion 33 judges these data together with information from the sheet size detection device 41 to command the motors 28*m*, 32*m*.

The sequence from the step S11 to the step S21 is repeated until the set or selected number of sheets are treated, and thereafter, the copying operation is finished (step S22).

Figure 10:
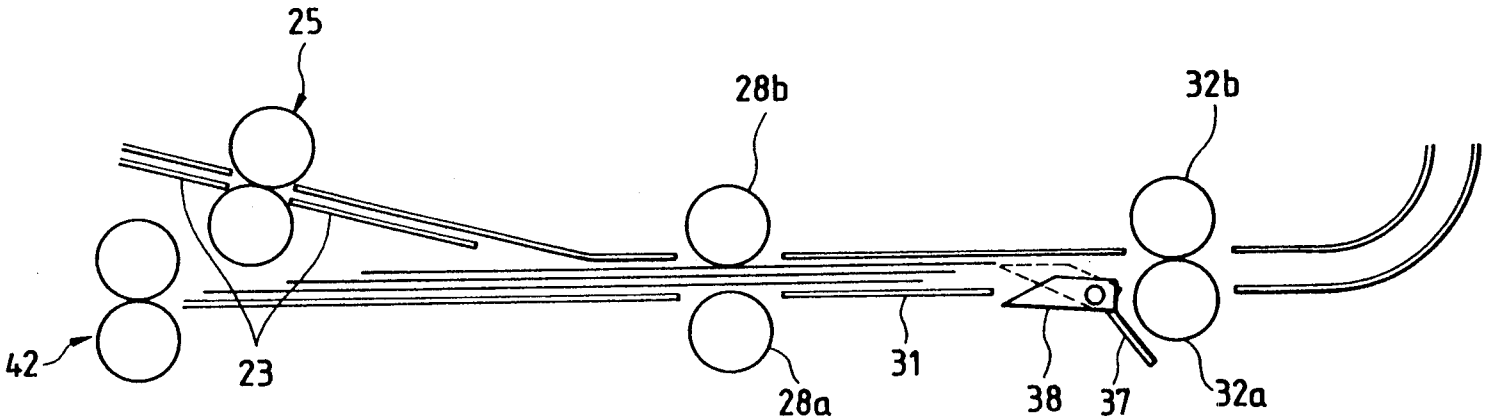
FIG. 10 is an elevational sectional view of the sheet feeding apparatus according to a second embodiment of the present invention.
Figure 11:
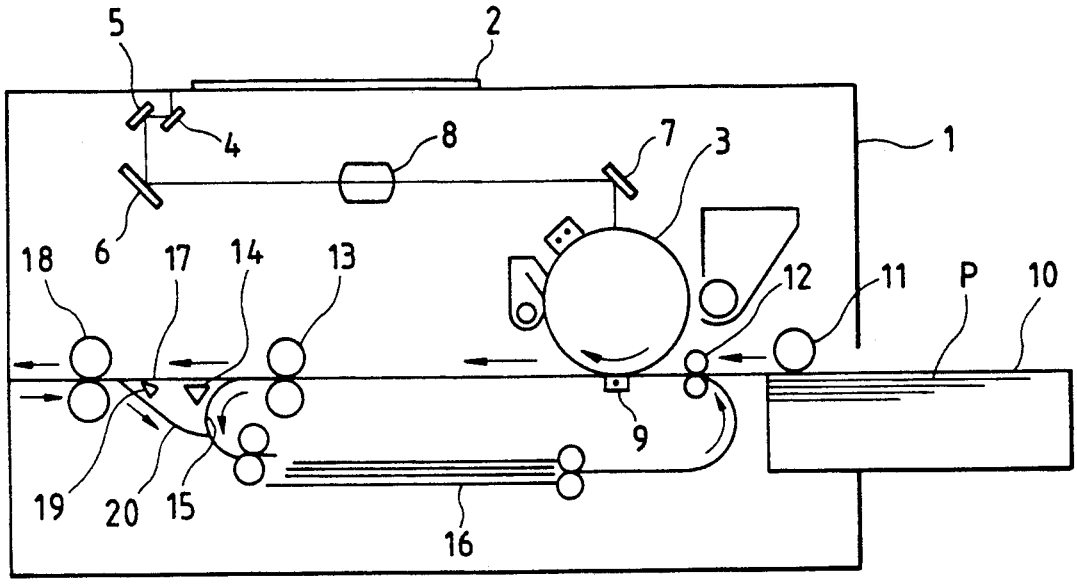
FIG. 11 PRIOR ART
FIG. 11 is an elevational sectional view of a conventional copying machine.

Incidentally, in the illustrated embodiment, while an example that the sheet is fed out (re-fed) from the bottom of the stacked sheets rested on the lower guide (intermediate tray) 27 (i.e., from the lowermost sheet $P_1$) was explained, the sheet may be fed out (re-fed) from the top of the stacked sheets (each having an image formed on its first surface) (i.e., an uppermost sheet), as a second embodiment shown in FIG. 10). To do so, the sheet stack may be formed by overlapping a next sheet on a previous sheet shifted back to obtain a distance (−l) (in place of the distance l in FIG. 6), and the branch guide 37 and the separating claw 38 may be arranged below the lower guide 31. To shift back the previous sheet by the distance (−l), a pair of rollers 42 are arranged below the sheet feeding path 23.

Figure 3D:
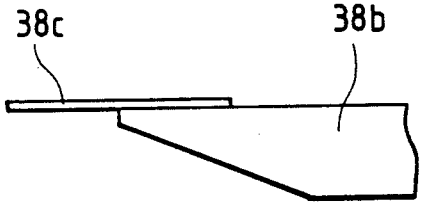

Further, the separating claw 38 may be constructed by attaching a thin elastic sheet 38*c* (polyester film having a thickness of 50 μm) to a holding member 38*b* (see FIG. 3D). In this case, in order to prevent the damage of the elastic sheet 38*c* (polyester film having a thickness of 50 μm), it was found, from the tests, that a protruding amount of the sheet may be smaller than 5 mm.

Figure 3E:
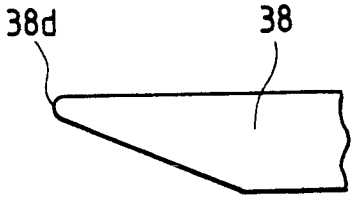

Further, as shown in FIG. 3E, the separating claw 38 may have a semi-circular free end. By adopting such configuration, the leading end of the sheet P can be prevented from being stopped by the free end 38*d* of the separating claw 38.

Further, the returning of the separating claw 38 in the step S19 may be effected between the steps S16 and S17.

Next, a third embodiment of the present invention will be explained with reference to FIGS. 16 to 23.

Figure 16:
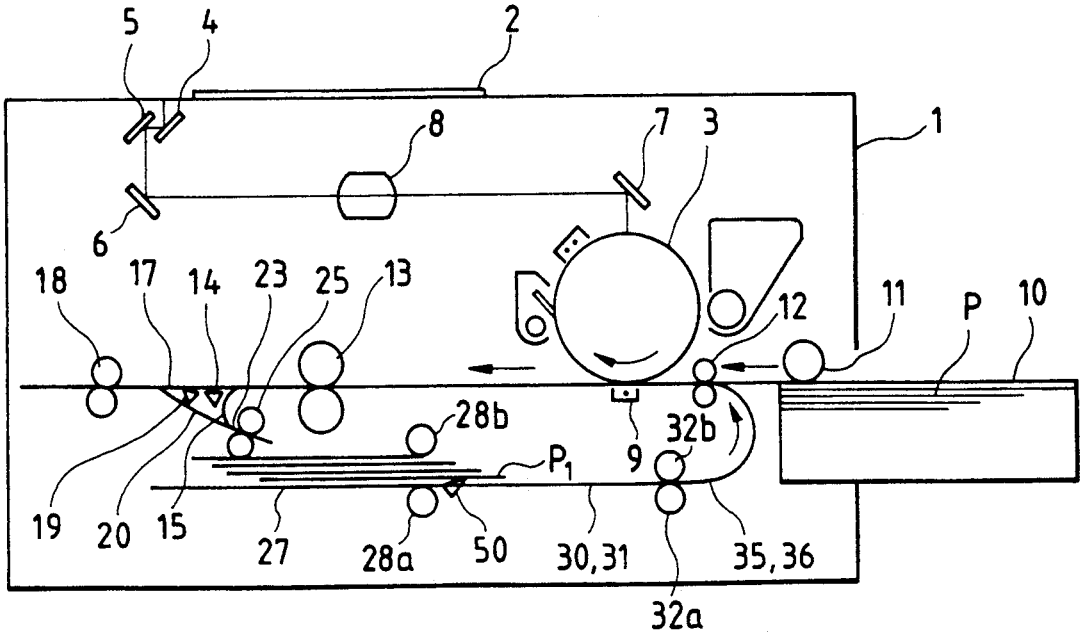
FIG. 16 is an elevational sectional view of a copying machine according to a third embodiment of the present invention.
Figure 17:
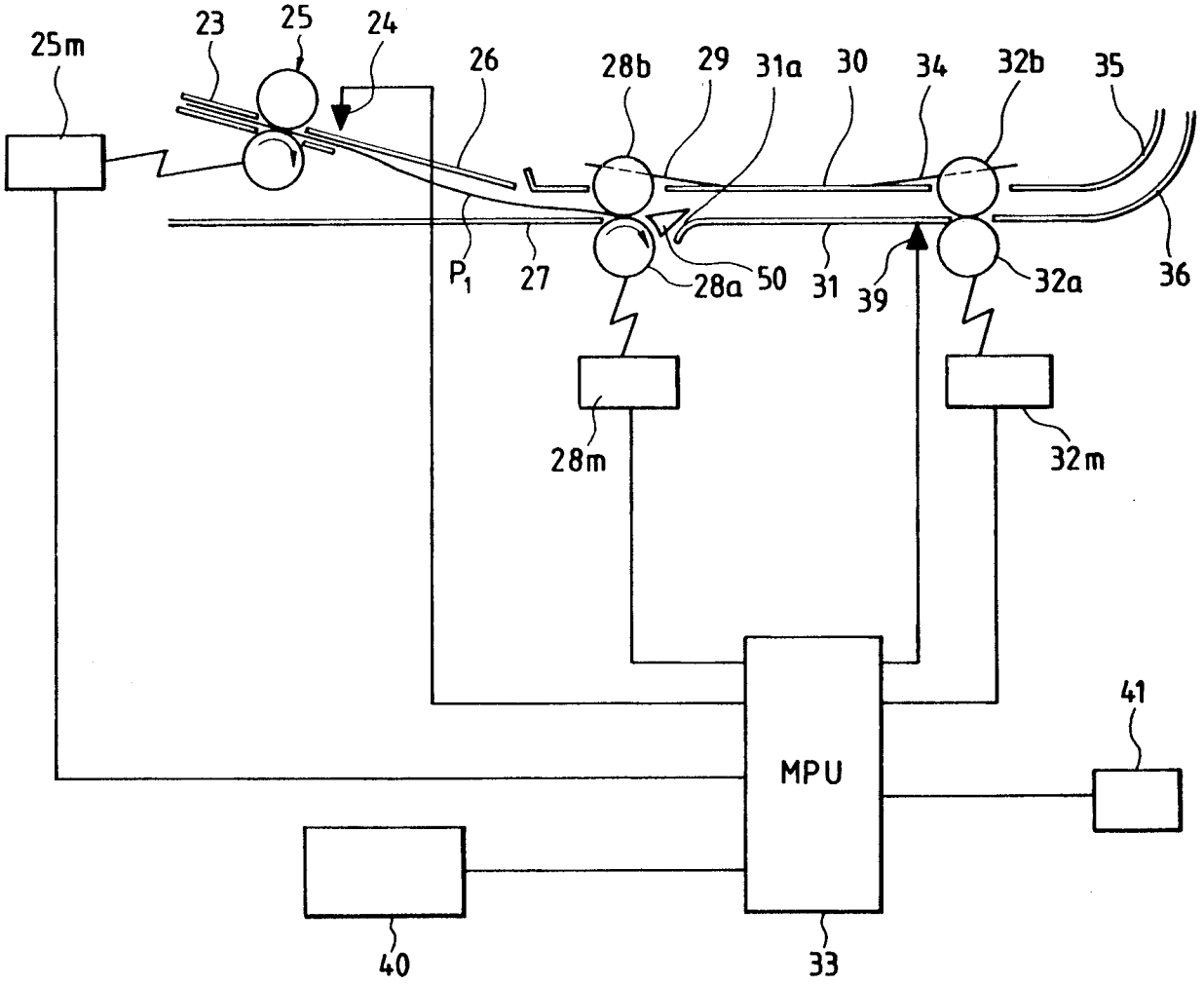
FIG. 17 is an elevational sectional view of a sheet feeding apparatus of FIG. 16.

FIGS. 16 and 17 show an image forming system incorporating the third embodiment of the present invention, which is embodied as a copying machine which can perform the two-sided printing operation and the multi-print operation with different colors.

Figure 2:
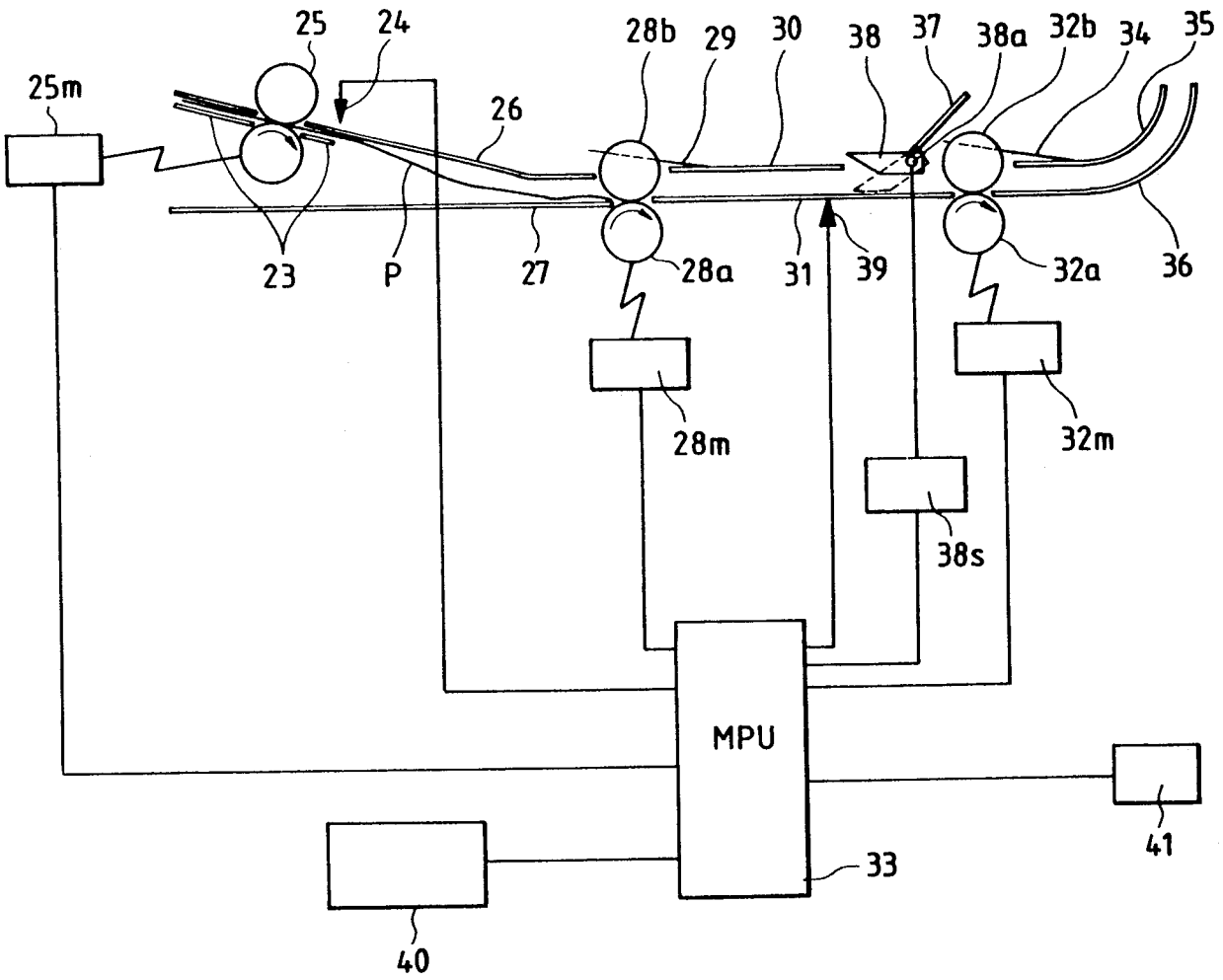
FIG. 2 is an elevational sectional view of the sheet feeding apparatus of FIG. 1.

In FIGS. 16 and 17, structural elements similar to those of the first embodiment shown in FIGS. 1 and 2 are designated by the same reference numerals and the explanation thereof will be omitted.

In FIGS. 16 and 17, a separating claw 50 having a free end directed toward a downstream side is arranged in the vicinity of a rear end of the lower guide 31 near the roller 28*b*, which separating claw protrudes slightly above the lower guide 31. The separating claw can separate the lowermost sheet $P_1$ fed back in the reverse direction from other sheets.

Further, the rear end of the separating claw 50 has a bent portion 31*a* bent downwardly to introduce the separated lowermost sheet $P_1$ between the separating claw and the lower guide.

Next, the operation of the copying machine according to this third embodiment will be explained.

A sequence for stacking a plurality of sheets on the lower guide (re-feeding path) is the same as that in the first embodiment described with reference to the flow chart of FIG. 4.

Figure 18:
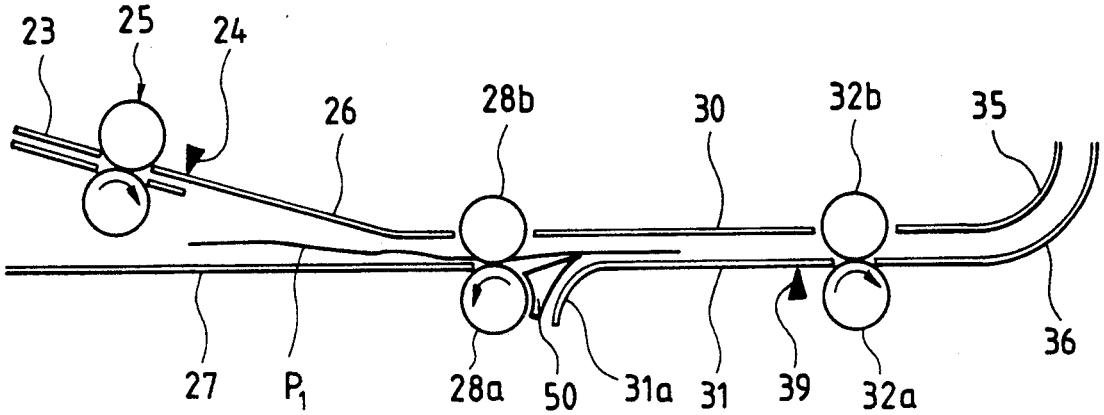
FIGS. 18, 19 and 20 are elevational sectional views of the sheet feeding apparatus showing successive sheet stacking conditions.
Figure 19:
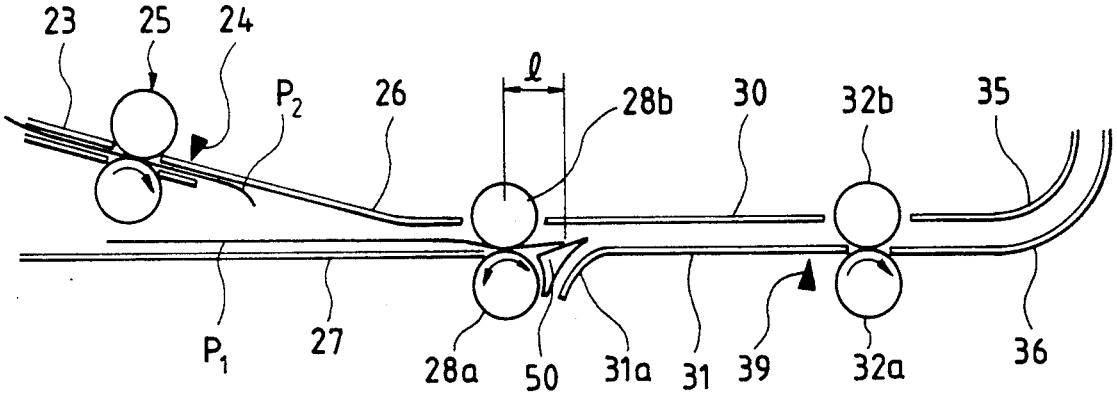
Figure 20:
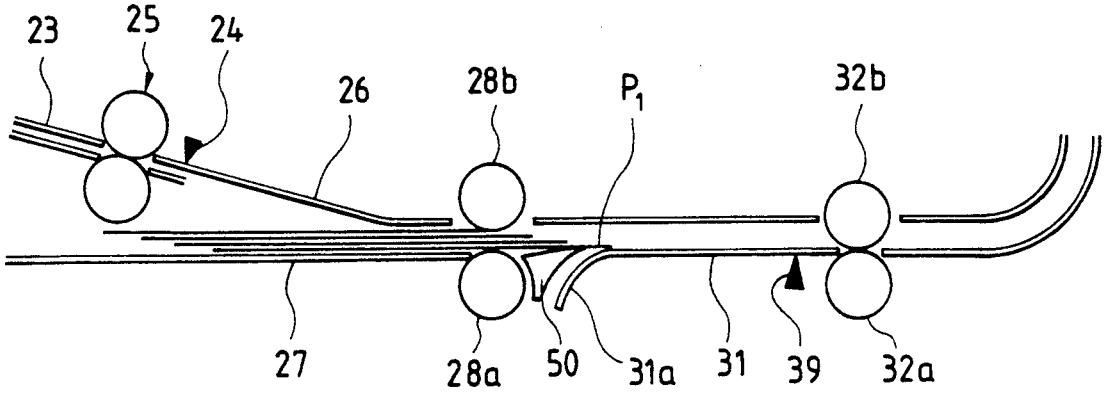

A manner that the sheets are stacked is shown in FIGS. 18 to 20. FIG. 18 shows a condition at a point that the step S5 in FIG. 4 is finished, FIG. 19 shows a condition at a point that the motor 28*m* is stopped in the step S8, and FIG. 20 shows a condition that the sheets are stacked by repeating the sequences of the steps S1 to S9 in the flow chart of FIG. 4.

Next, a sequence for re-feeding the stacked sheets P for a second image forming operation in the two-sided printing mode or the multi-print mode will be described with reference to a flow chart of FIG. 21.

Figure 22:
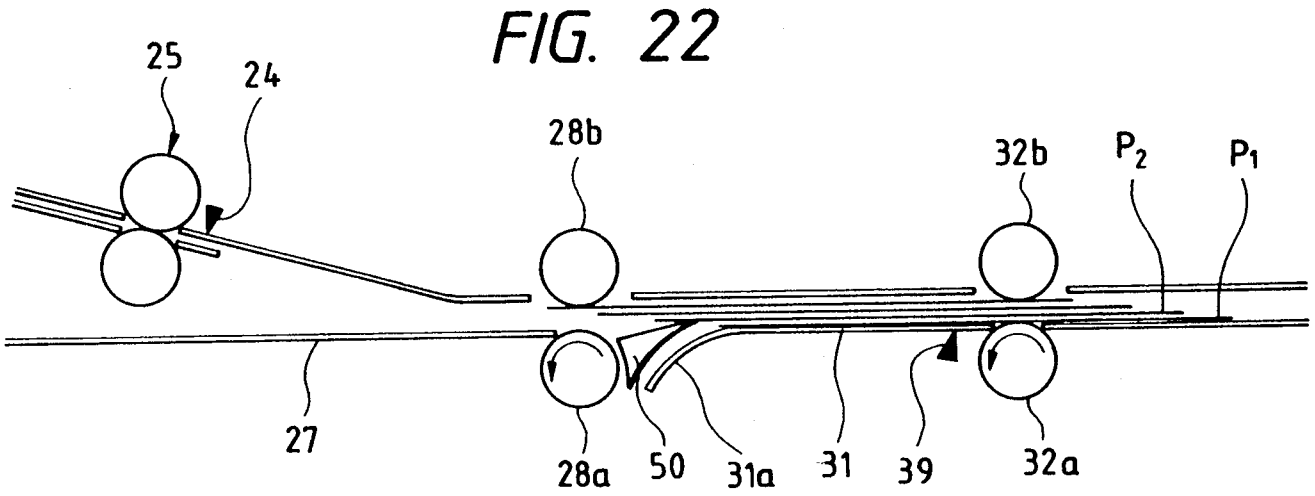
FIGS. 22 and 23 are elevational sectional views of the sheet feeding apparatus showing successive sheet feeding conditions.

When the start is commanded through the keyboard 40 (step S111), the motors 28*m* and 32*m* start to be rotated (steps S112, S113) and the stacked sheets P are sent to the paired rollers 32*a*, 32*b*. At a point that the trailing end of the lowermost sheet $P_1$ has passed through the separating claw 50 and the trailing end of the second sheet $P_2$ contacts the separating claw 50, i.e., at a point that after a predetermined time period $t_{13}$ has been elapsed from when the sensor 37 is turned ON by the lowermost sheet $P_1$, the motor 28*m* is reversed (steps S114, S115, S116, S117). This condition is shown in FIG. 22. After a time period $t_{14}$ has been elapsed from the initiation of the reverse movement of the stacked sheets, only the lowermost sheet $P_1$ is pinched by the paired rollers $32_a$, 32*b*.

Figure 23:
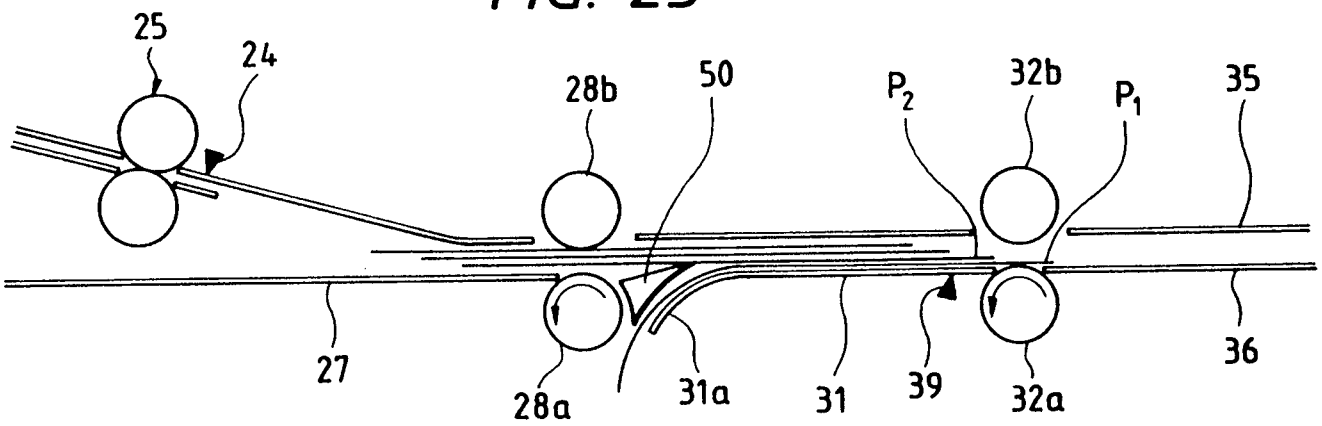

During the reverse movement of the stacked sheets P in the steps S116 and S117, the lowermost sheet $P_1$ is separated from the other sheets by the separating claw 50 and is guided between the separating claw 50 and the bent portion 31*a*, with the result that the lowermost sheet is not pinched by the paired rollers 28*a*, 28*b*. At the same time, the motor 28*m* is stopped and the motor 32*m* is normally rotated (steps S118, S119, S120). This condition is shown in FIG. 23.

After a time period $t_{15}$ has been elapsed, the leading end of the lowermost sheet $P_1$ reaches the regist rollers 12, and, at the point that a loop is formed in the sheet, the motor 32*m* is stopped (step S121, S122). In the steps S116, S117, the lowermost sheet $P_1$ is introduced between the separating claw 50 and the bent portion 31*a* and other stacked sheets including the second sheet $P_2$ are shifted back on the lower guide 27.

In the steps S119, S120, the reverse movement of the stacked sheets is stopped, and at the same time the lowermost sheet $P_1$ is fed out by means of the paired rollers 32*a*, 32*b*. When the set number of sheets are not yet re-fed, the sequence returns to the step S112, and the same sequence is repeated. On the other hand, when the set number of sheets are re-fed (step S123), the sequence is ended. During the conveyance of the lowermost sheet $P_1$, since the other stacked sheets are pinched by the paired rollers 28*a*, 28*b*, these remaining sheets are not fed together with the lowermost sheet.

With the above-mentioned arrangement, it is possible that the sheets having different sizes be stacked in the stepped fashion and be separated and re-fed one by one, without changing the distance between the paired rollers 28*a*, 28*b* and 32*a*, 32*b*. That is to say, in the case where the sheets P are stacked in the stepped fashion, the time periods $t_2$ and $(t_2-\Delta t)$ in the flow chart of FIG. 4 may be changed in accordance with the length of the sheet in a feeding direction. In order to draw out the trailing end of the sheet from the paired rollers 25, the time period $t_2$ may be prolonged as the longer sheet is treated. Similarly, by setting the time period $(t_2-\Delta t)$ in accordance with the length of the sheet, the sheets having different sizes can be stacked in the stepped fashion with offsetting by the distance l, respectively.

Figure 21:
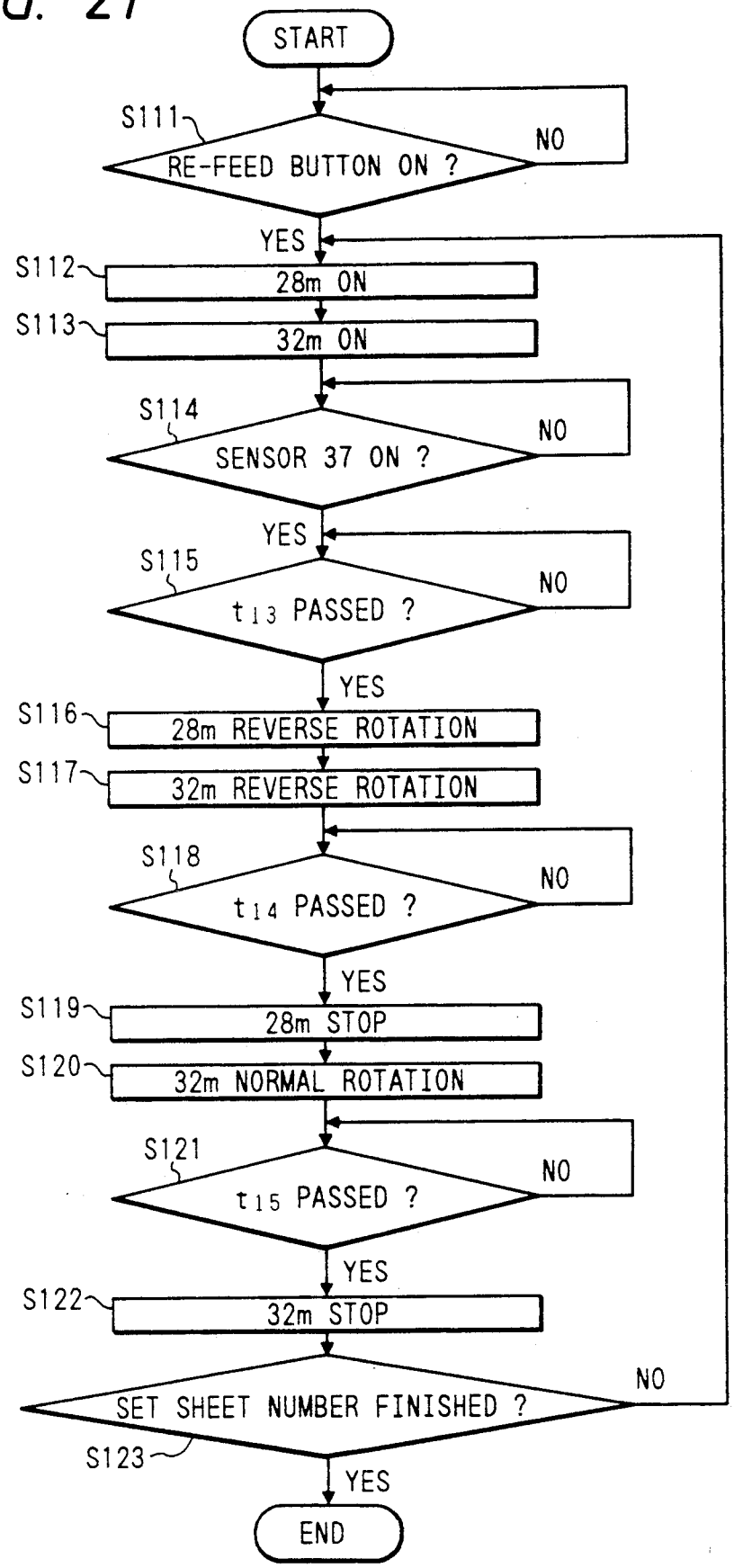
FIG. 21 is a flow chart for feeding the sheet.

Further, in the case where the sheets are separated and re-fed one by one, the time periods $t_{13}$, $t_{14}$ and $t_{15}$ in the flow chart of FIG. 21 may be changed in accordance with the length of the sheet P. Since the time period $t_3$ corresponds to a time required for drawing out the trailing end of the lowermost sheet $P_1$ from the free end of the separating claw 50, this time period is set to be prolonged as the longer sheet is treated. Similarly, since the time period $t_4$ corresponds to a time required for drawing out the stacked sheets not to be re-fed from the paired rollers 32*a*, 32*b*, this time period is also set to be prolonged as the longer sheet is treated. The size of the sheet P is detected by the sheet size detection device 41 of FIG. 2, and, in accordance with the detected size of the sheet, the time periods $t_2$, $(t_2-\Delta t)$, $t_3$, $t_4$ and $t_5$ are calculated by the controlling portion 33. The sheet size detection device 41 may be of any conventional type wherein the size of the sheet is detected from the cassette or wherein the size of the sheet is detected on the basis of the time passing through the sensor.

As mentioned above, according to the illustrated embodiment, as shown in FIG. 23, only the lowermost sheet $P_1$ can be re-fed by means of the paired rollers 32*a*, 32*b* while pinching and holding the other sheets P by means of the paired rollers 28*a*, 28*b*. Accordingly, there is no frictional sliding movement between the sheets $P_1$ and $P_2$ in the nip area. Further, since the trailing end of the lowermost sheet $P_1$ is retarded below the paired rollers 28*a*, 28*b* through the bent portion 31*a* of the lower guide 31, the frictional sliding movement between the sheets can be prevented regardless of the size of the sheet, without changing the distance between the paired rollers 28*a*, 28*b* and 32*a*, 32*b*, and accordingly, it is not needed to lengthen the sheet feeding paths 27, 31 and the like for preventing such frictional sliding movement.

Figure 24:
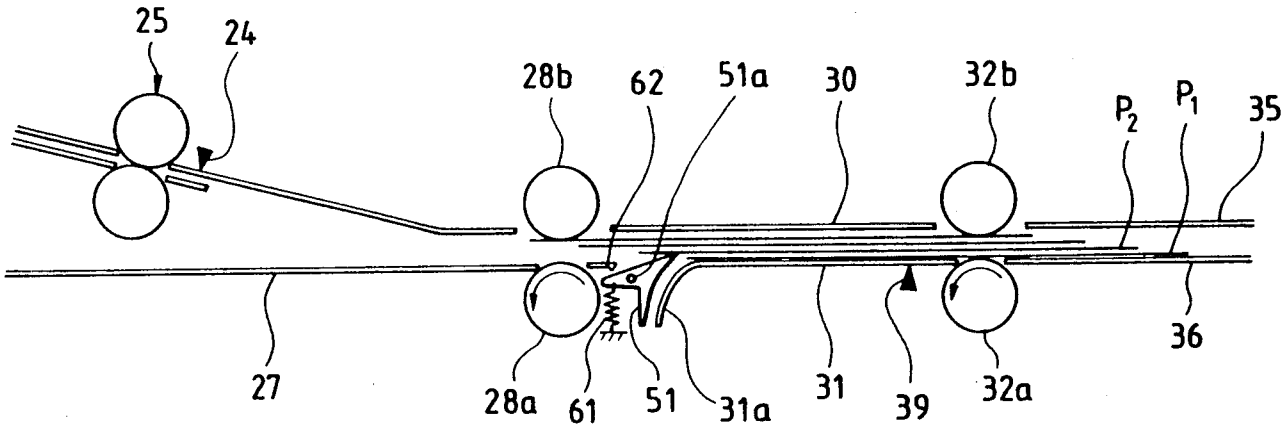
FIG. 24 is an elevational sectional view of a sheet feeding apparatus according to a fourth embodiment of the present invention.

Next, a fourth embodiment of the present invention will be explained with reference to FIG. 24.

In this fourth embodiment, a separating claw 51 is rotatably mounted on a shaft 51*a* and is weakly biased in an anti-clockwise direction (to urge a free end of the claw against the stacked sheets) by means of a tension spring 61. Further, a stopper 62 is provided for preventing the separating claw 51 from lowering below a position where the separating claw protrudes slightly above the lower guide 31.

With this arrangement, even if the stacked sheets are irregular due to the curled ends thereof or the first sheet $P_1$ is difficult to be separated from the second sheet $P_2$ due to the electrostatic adhesion between these sheets, since the free end of the separating claw 51 is positively engaged by the sheet P, the first or lowermost sheet $P_1$ can be separated more effectively.

Figure 25:
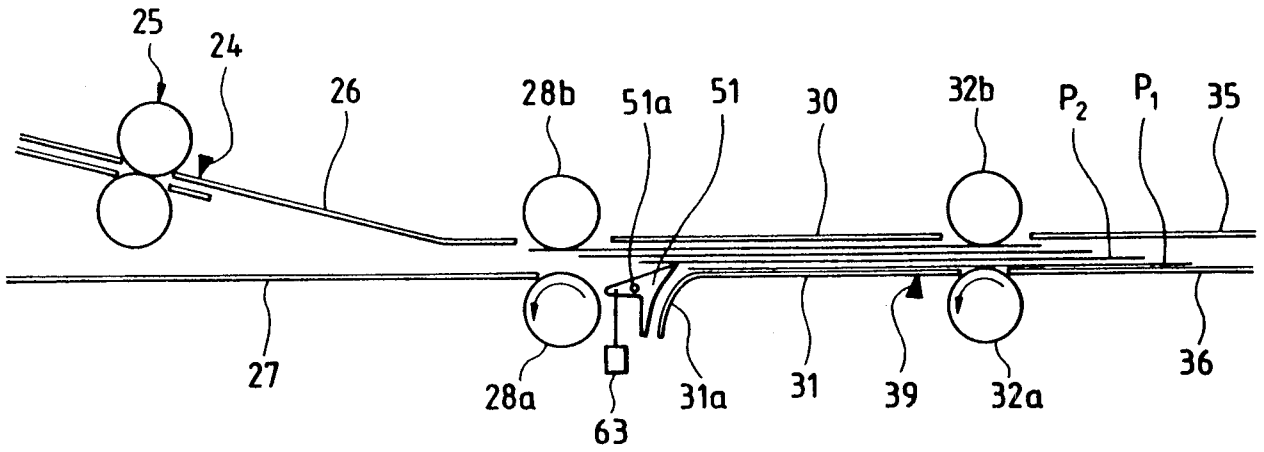
FIG. 25 is an elevational sectional view of a sheet feeding apparatus according to a fifth embodiment of the present invention.

Next, a fifth embodiment of the present invention will be explained with reference to FIG. 25.

In this fifth embodiment, in place of the tension spring 61 in the fourth embodiment, a solenoid 63 is provided for positioning the separating claw 61, and the stopper 62 is omitted.

Figure 26:
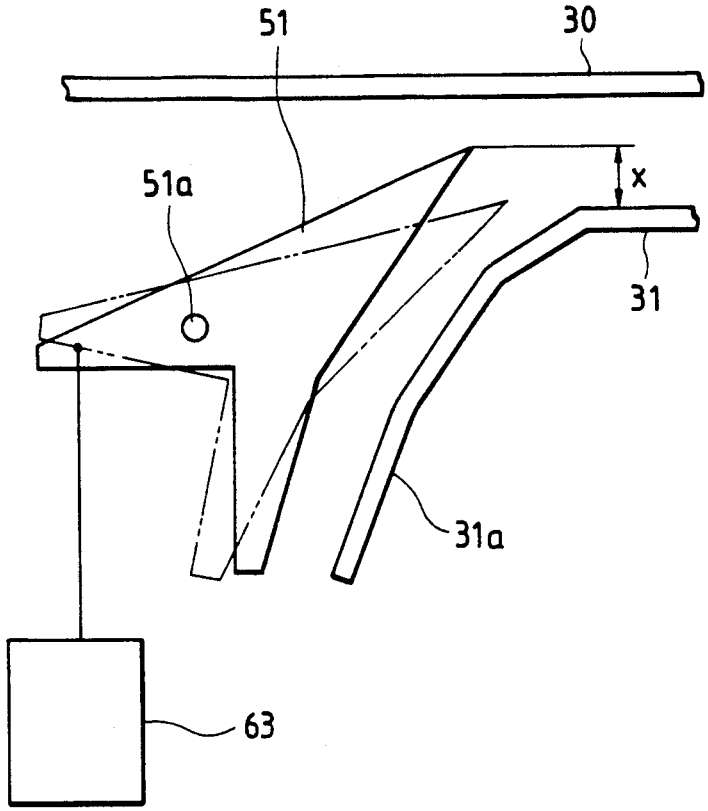
FIG. 26 is an enlarged sectional view showing an operation of the apparatus.

With this arrangement, as shown in FIG. 26, when the first or lowermost sheet $P_1$ is separated from the second sheet $P_2$, a protruding amount x of the free end of the separating claw 51 above the lower guide 31 is increased to facilitate the separation of the lowermost sheet from the other sheets; whereas, when the other sheets are shifted, the protruding amount x is decreased to reduce the resistance against shifting of the sheets. In this way, the solenoid 63 controls two positions of the separating claw.

Figure 27:
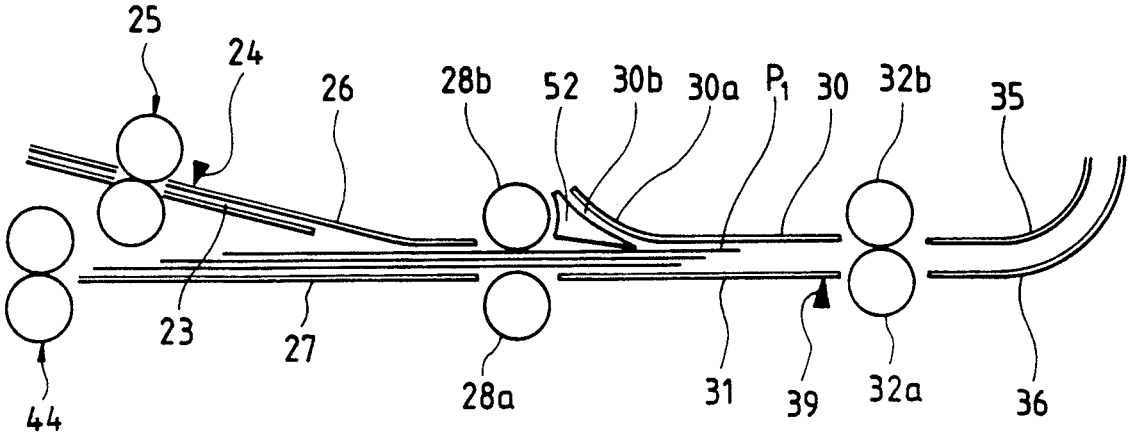
FIG. 27 is an elevational sectional view of a sheet feeding apparatus according to a sixth embodiment of the present invention.

Next, a sixth embodiment of the present invention will be explained with reference to FIG. 27.

In this sixth embodiment, the offset distance l as shown in FIG. 19 is reversed to (−l). With this arrangement, a next sheet P is stacked or overlapped on the previous sheet or sheets with offsetting the leading end of the next sheet by the distance l in the sheet re-feeding direction. In this case, an uppermost sheet, i.e., lastly stacked sheet $P_1$ will be firstly re-fed.

Further, since the sheet P cannot be shifted leftwardly by the distance (−l) by means of the paired rollers 28*a*, 28*b*, a pair of rollers 44 are provided in connection with the lower guide 27. Furthermore, since the first sheet (firstly re-fed sheet) $P_1$ is rested on the sheet stack, a bent portion 30*a* is formed on the upper guide 30 and cooperates with a separating claw 52 to form a sheet retarding path 30*b*.

Next, a seventh embodiment of the present invention will be explained with reference to FIGS. 28 to 34.

Figure 28:
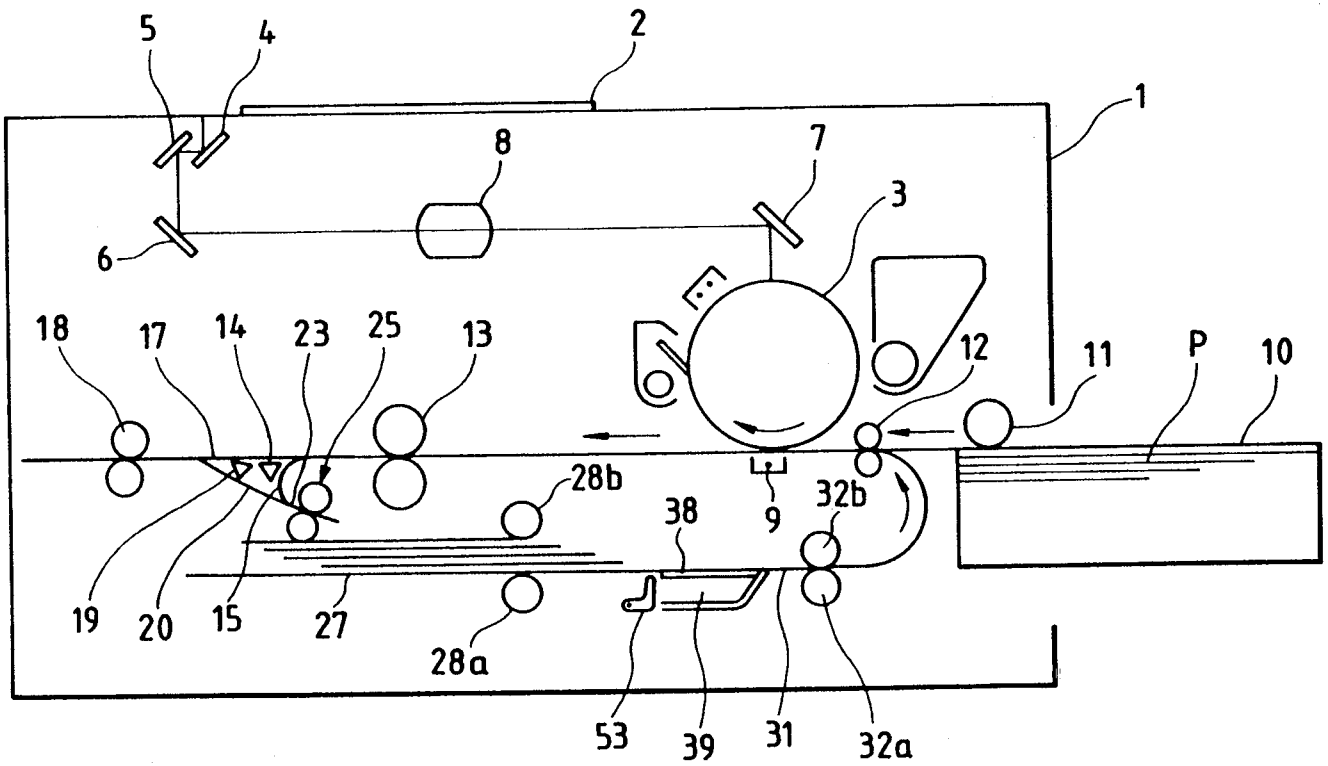
FIG. 28 is an elevational sectional view of a copying machine according to a seventh embodiment of the present invention.

FIG. 28 shows an image forming system incorporating the seventh embodiment of the present invention, which is embodied as a copying machine which can perform the two-sided printing operation and the multi-print operation with different colors.

Figure 29:
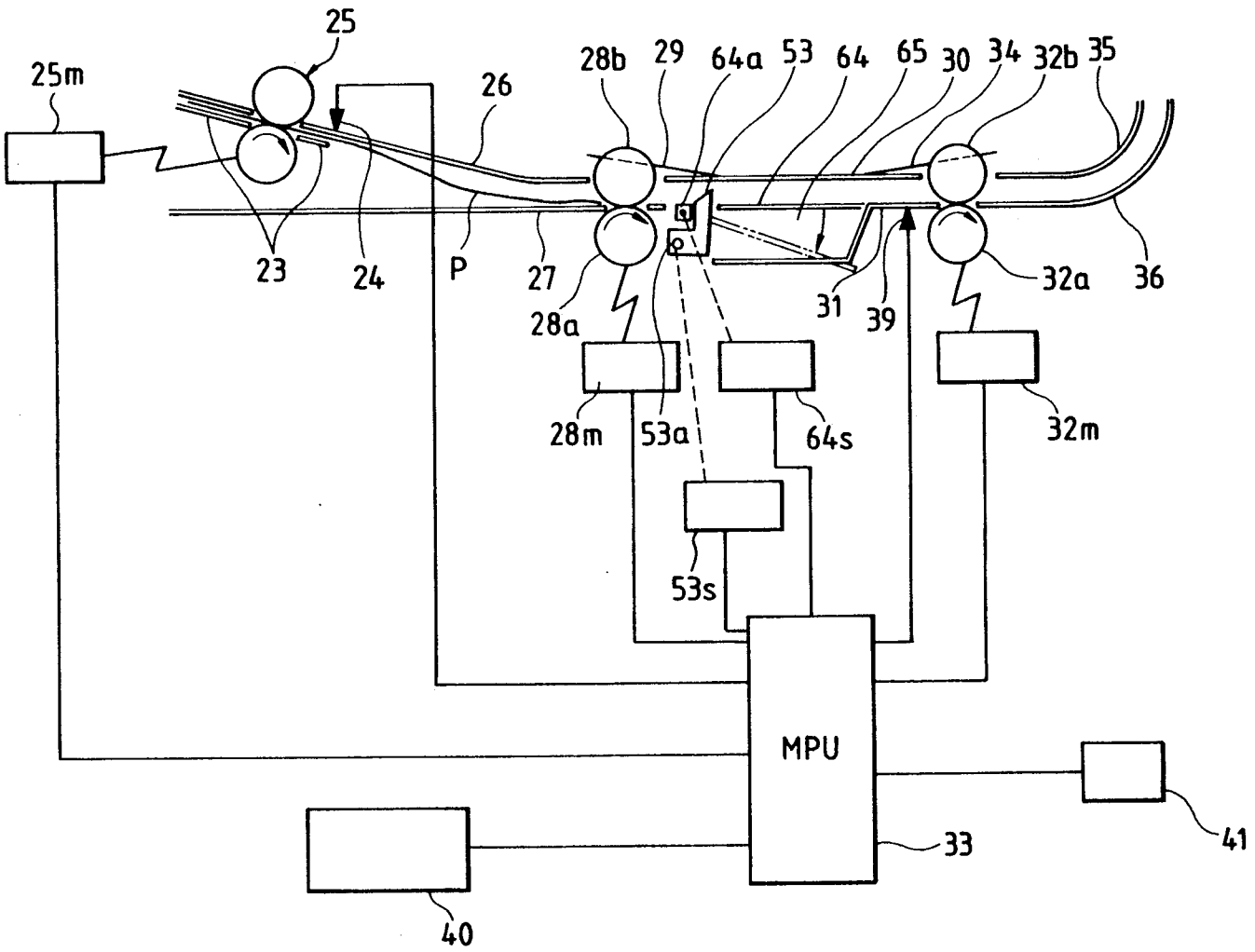
FIG. 29 is an elevational sectional view of a sheet feeding apparatus of FIG. 28.

In FIGS. 28 and 29, structural elements similar to those of the first embodiment shown in FIGS. 1 and 2 are designated by the same reference numerals and the explanation thereof will be omitted.

An L-shaped stopper 53 is rotatably mounted on a shaft 53*a* in the vicinity of a rear end of the lower guide 31 near the paired rollers 28*a*, 28*b* to be extended or retracted through an opening formed in the lower guide 31.

Further, on a shaft 64*a* disposed near the shaft 53*a*, there is rotatably mounted a switching guide plate 64 which can form a part of the lower guide 31 when closed and can be opened toward a lower retarding space 65.

Next, the operation of the copying machine according to this seventh embodiment will be explained.

A sequence for stacking a plurality of sheets on the lower guide (re-feeding path) 27 is the same as that in the first embodiment described with reference to the flow chart of FIG. 4.

Figure 30:
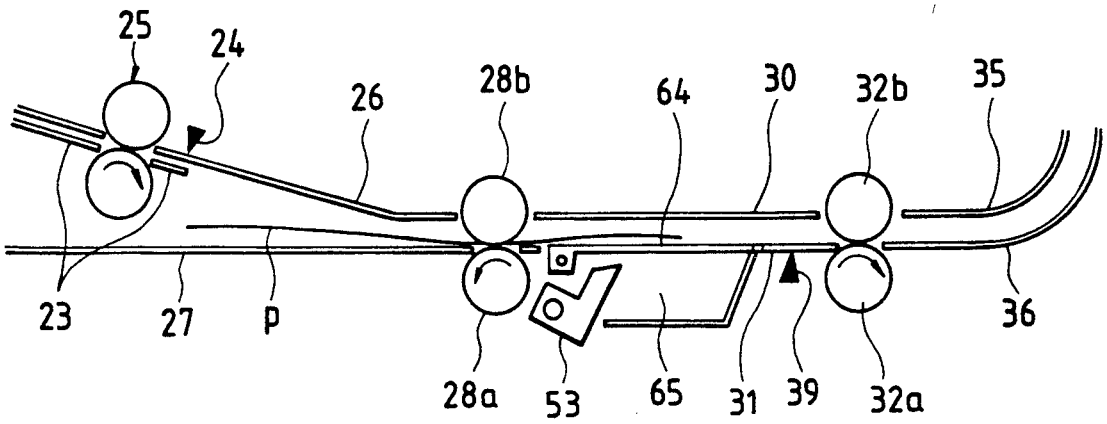
FIGS. 30, 31 and 32 are elevational sectional views of the sheet feeding apparatus showing successive sheet stacking conditions.
Figure 31:
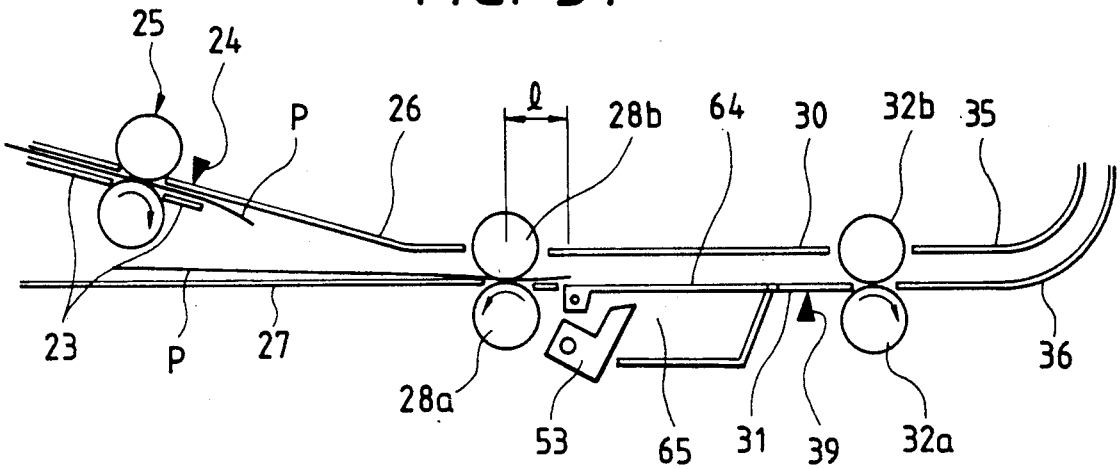
Figure 32:
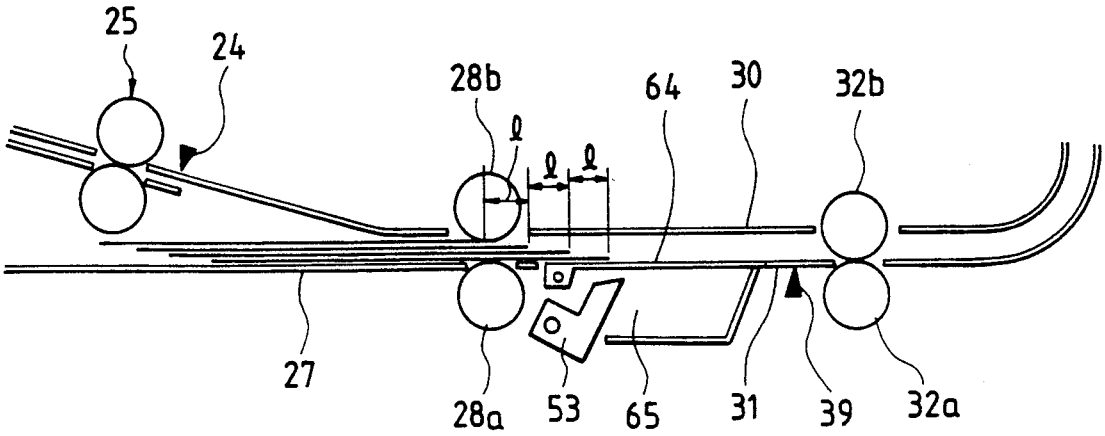

A manner that the sheets are stacked is shown in FIGS. 30 to 32. FIG. 30 shows a condition at a point that the step S5 in FIG. 4 is finished, FIG. 31 shows a condition at a point that the motor 28*m* is stopped in the step S8, and FIG. 20 shows a condition that the sheets are stacked by repeating the sequences of the steps S2 to S9 in the flow chart of FIG. 4.

Next, a sequence for re-feeding the stacked sheets P for a second image forming operation in the two-sided printing mode or the multi-print mode will be described with reference to a flow chart of FIG. 33.

Figure 34:
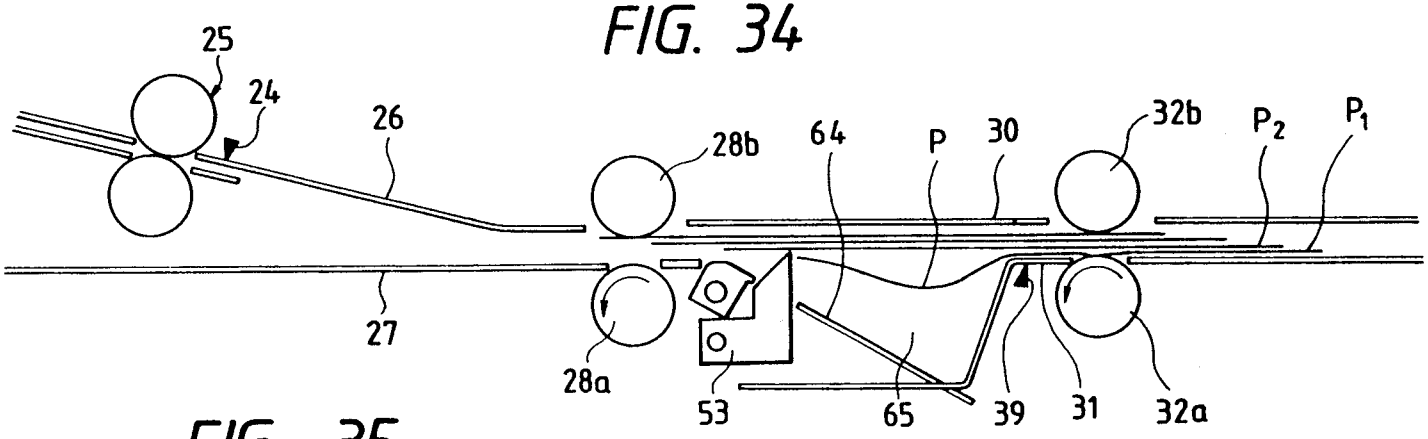
FIG. 34 is an elevational sectional view of the sheet feeding apparatus showing a condition that a trailing end of a first sheet is stopped by a first sheet stopper means.

When the start is commanded through the keyboard 40 (step S211), the motors 28*m* and 32*m* start to be rotated (steps S212, S213) and the stacked sheets P are sent to the paired rollers 32*a*, 32*b*. When the trailing end of the first sheet P passes through a position above the stopper 53, a solenoid 53*s* for driving the stopper 53 and a solenoid 64*s* for driving the switching guide plate are turned ON (step S216), so that the stopper 53 is protruded above the switching guide plate 64 to stop the trailing end of the first sheet P and the switching guide plate 64 is opened. Then, the motors 28*m*, 32*m* are rotated reversely (steps S217, S218). The timing for reversing these motors is set by a time period $t_{23}$ elapsed (step S215) after the leading end of the first sheet P is detected by the sensor 39 (step S214). At this point, the lowermost sheet P, and other sheets rested on the lowermost sheet and positioned between the paired rollers 32*a*, 32*b* are all pinched by the paired rollers 32*a*, 32*b*, as shown in FIG. 34.

By the reverse rotations of the motors 28*m*, 32*m* (steps S217, S218), the trailing end of the lowermost (first) sheet P is abutted against the stopper 53, with the result that the lowermost sheet is flexed to be retarded into the retarding space 65. The other stacked sheets P are shifted on the lower guides 27, 31 in the reverse direction by means of the paired rollers 28*a*, 28*b* and 32*a*, 32*b*.

Then, at the point that only the first sheet P is pinched by the paired rollers 32*a*, 32*b*, the motor 28*m* is stopped and at the same time the motor 32*m* is rotated normally (steps S219, S220, S221). Then, at the point that the first sheet P reaches a next pair of rollers, the motor 32*m* is stopped (steps S222, S223). Incidentally, a time period $t_{24}$ in the step S219 and a time period $t_{25}$ in the step S222 are set by the controlling portion 33 on the basis of the information from the sensor 39 and the size detection device 41.

While the first sheet P is being conveyed by the paired rollers 32*a*, 32*b*, since the other sheets P are pinched by the paired rollers 28*a*, 28*b*, only the first sheet P is positively separated and is sent to the next paired rollers.

At a time that the motor 32*m* is stopped, the stopper 53 and the switching guide plate 64 are returned to their original positions (step S224). Further, if the set number of sheets are not yet re-fed, the sequence returns to the step S212 and the above-mentioned operation is repeated; whereas, when the set number of sheets are re-fed (step S225), the copying operation is ended.

Figure 33:
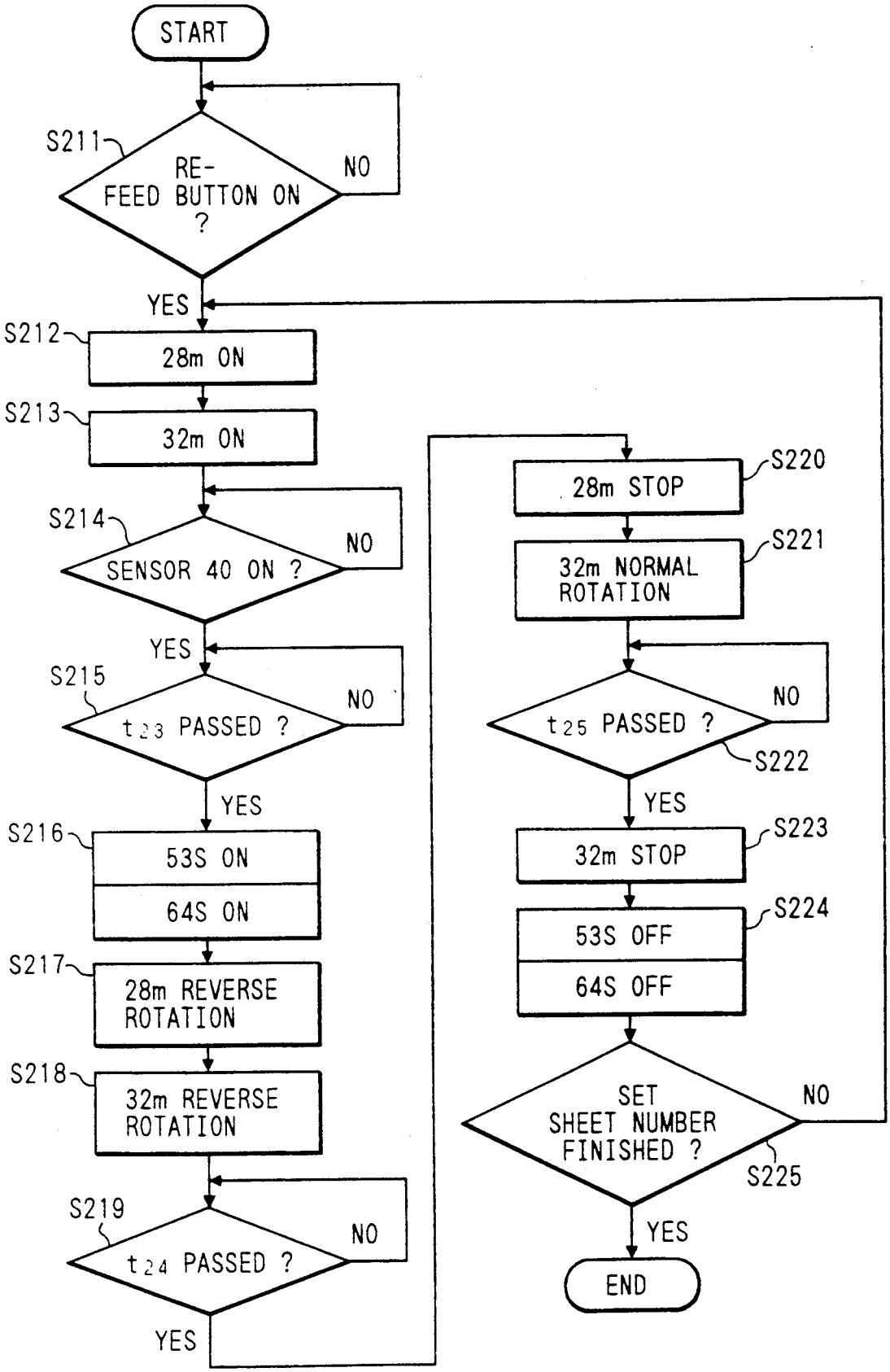
FIG. 33 is a flow chart for feeding the sheet.

Incidentally, in the illustrated embodiment, while an example that the sheets are stacked on the lower guide (intermediate tray) 27 with preceding the lowermost sheet and the stacked sheets are conveyed (re-fed) from the lowermost sheet was explained, by reversing the distance ( as shown in FIG. 33 to (−l), i.e., by shifting the lowermost sheet P back so that the leading end of the sheet is positioned at a distance l from the paired rollers 28*a*, 28*b* in the upstream direction (to do so, another pair of rollers are provided in the feeding path at the left of the paired rollers 28*a*, 28*b*), and by arranging the stopper 53, switching guide plate 64 and retarding space 65 above the upper guide 30, the stacked sheets may be conveyed (re-fed) from the uppermost sheet (lastly copied sheet).

Next, a eighth embodiment of the present invention will be explained with reference to FIGS. 35 to 41.

Figure 35:
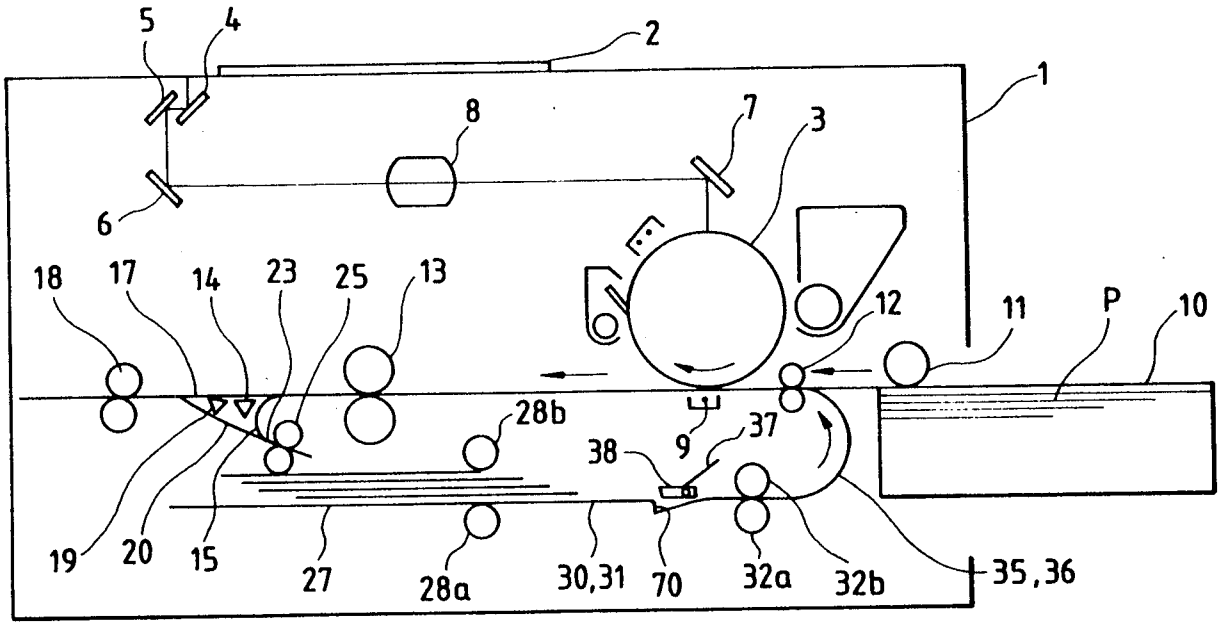
FIG. 35 is an elevational sectional view of a copying machine according to a eighth embodiment of the present invention.
Figure 36A:
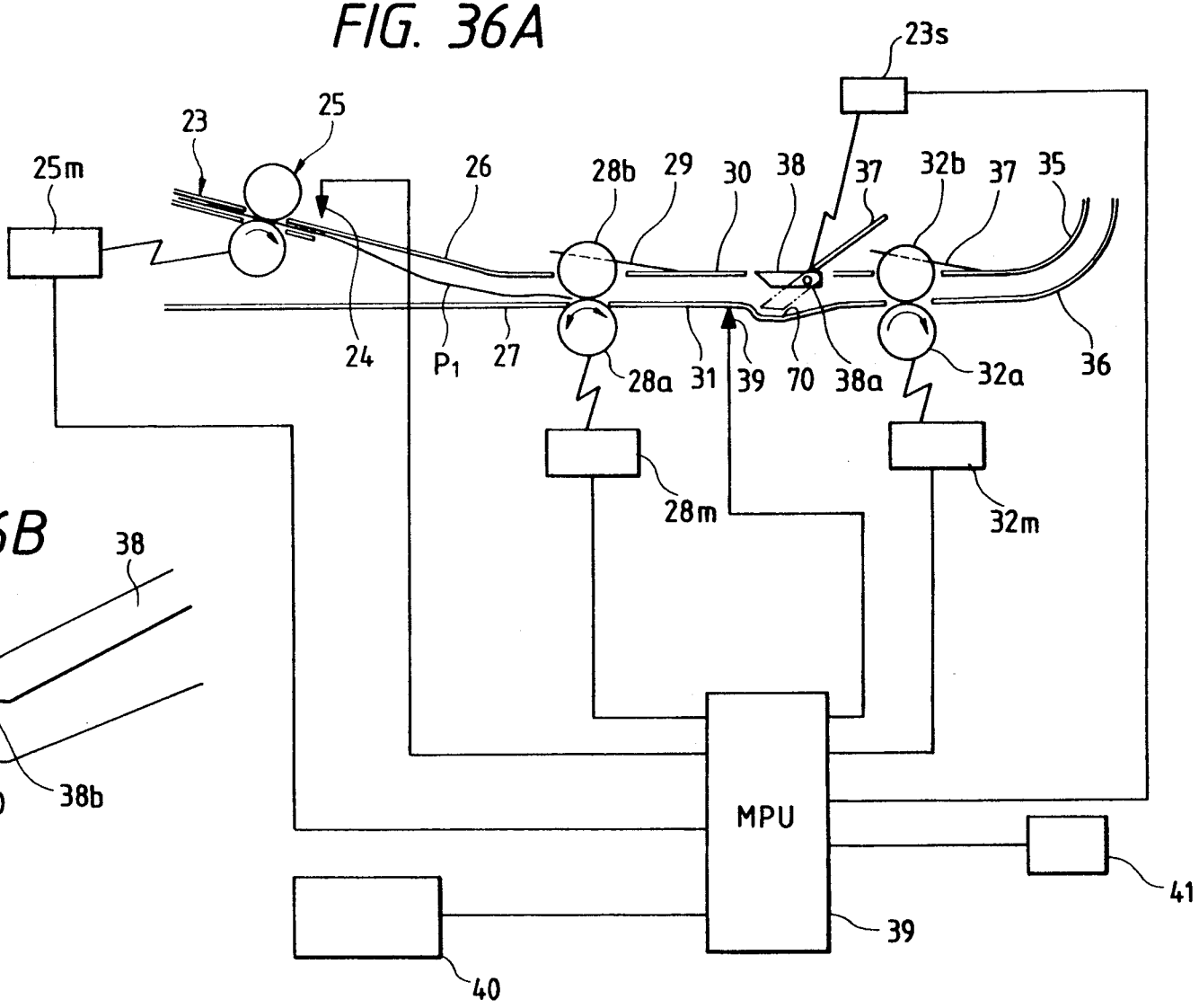
FIG. 36A is an elevational sectional view of a sheet feeding apparatus of FIG. 35.

FIGS. 35 and 36 show an image forming system incorporating the eighth embodiment of the present invention, which is embodied as a copying machine which can perform the two-sided printing operation and the multi-print operation with different colors. In FIGS. 35 and 36, structural elements similar to those of the first embodiment shown in FIG. 1 are designated by the same reference numerals and the explanation thereof will be omitted.

A branch guide 37 extending rearwardly and upwardly is arranged on the upper guide 30 near the paired rollers 32*a*, 32*b*, and a flapper (separating claw) 38 is rotatably supported on a shaft 38*a* at a base end of the flapper 38.

Figure 36B:
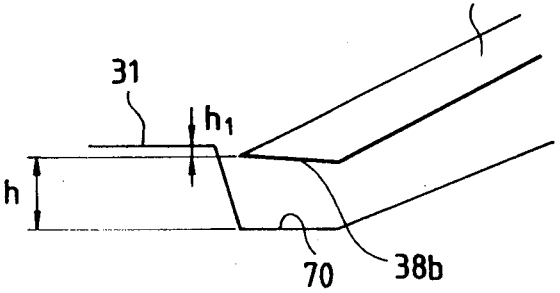
FIG. 36B is an enlarged elevational view showing a relation between a flapper and a sheet feeding path.

Further, the lower guide 31 has a recessed portion 70 in the vicinity of a lowered position of the flapper 38. As shown in FIG. 36B, a bottom surface 38*b* of the flapper 38 is spaced apart by a distance H from a bottom surface of the recessed portion 70 and is positioned slightly below the surface of the lower guide 31 by a distance $h_1$, when the flapper is lowered.

Next, the operation of the copying machine according to this embodiment will be explained.

A sequence for stacking a plurality of sheets on the lower guides (re-feeding path) 27, 31 is the same as that in the first embodiment described with reference to the flow chart of FIG. 4.

Figure 37:
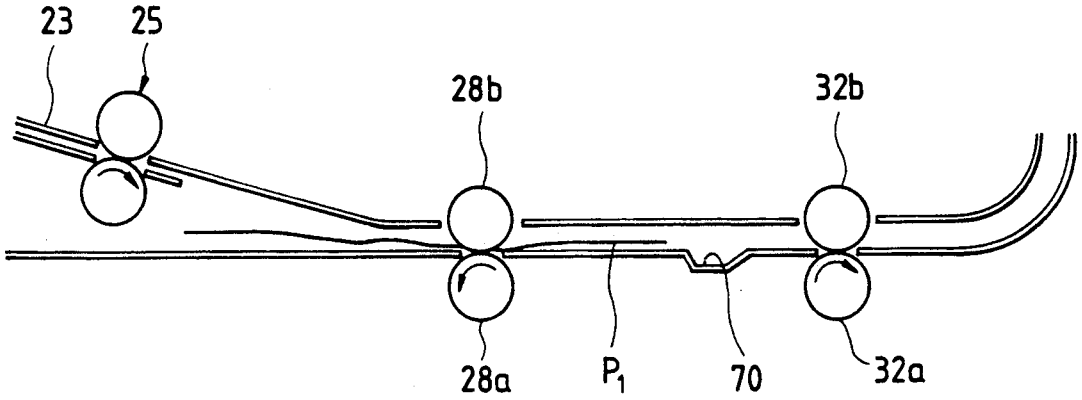
FIGS. 37, 38 and 39 are elevational sectional views of the sheet feeding apparatus showing successive sheet stacking conditions.
Figure 39:
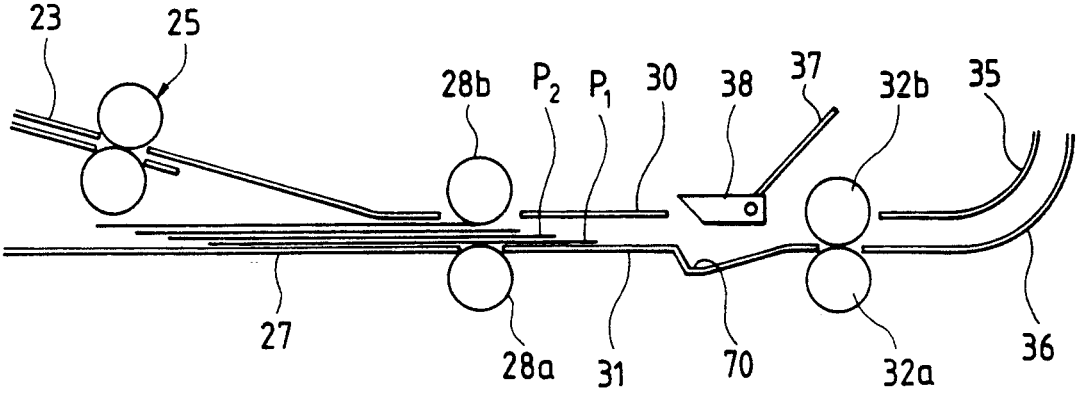

A manner that the sheets are stacked is shown in FIGS. 37 to 39. FIG. 37 shows a condition at a point that the step S5 in FIG. 4 is finished, FIG. 38 shows a condition at a point that the motor 28*m* is stopped in the step S8, and FIG. 39 shows a condition that the sheets are stacked by repeating the sequences of the steps S1 to S9 in the flow chart of FIG. 4.

Figure 8:
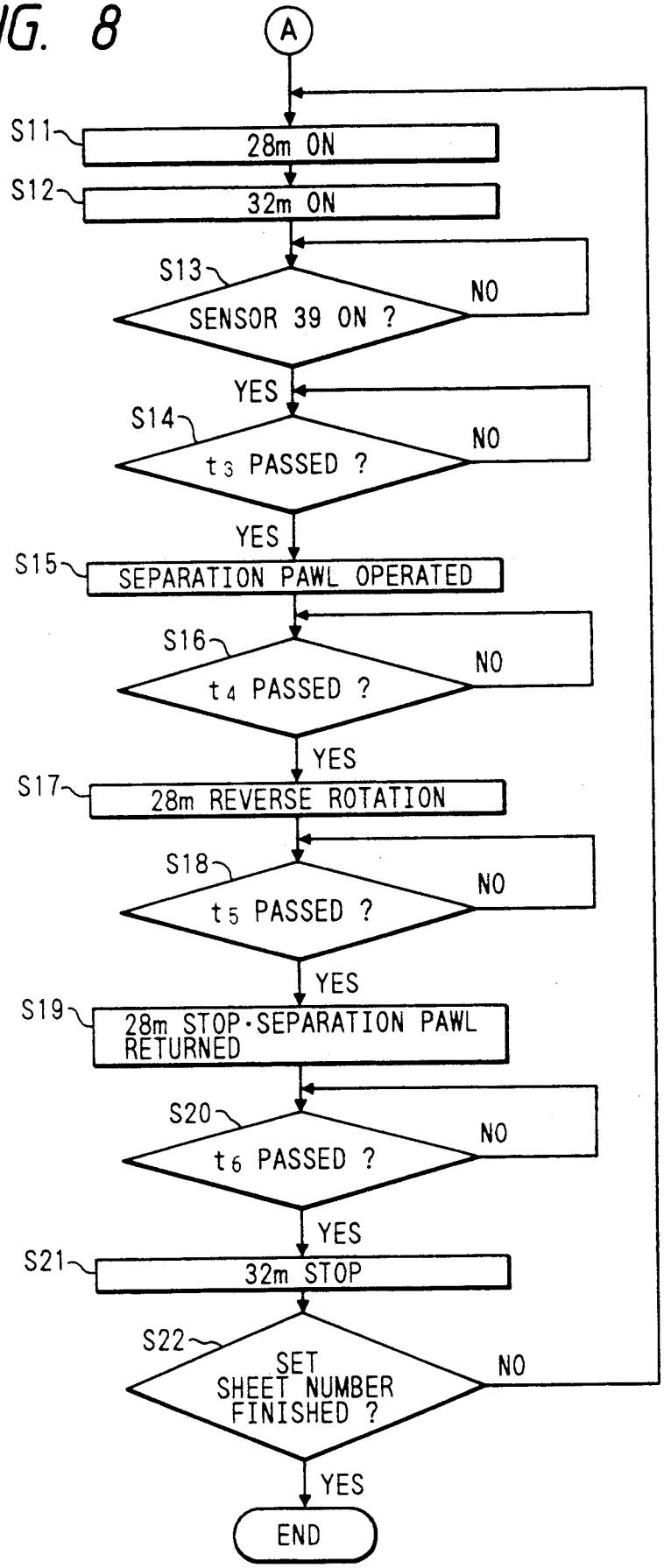
FIG. 8 is a flow chart for feeding the sheet.

A sequence for separating and re-feeding the stacked sheets one by one is the same as that in the first embodiment, and thus, is executed in accordance with the flow chart of FIG. 8.

Figure 40:
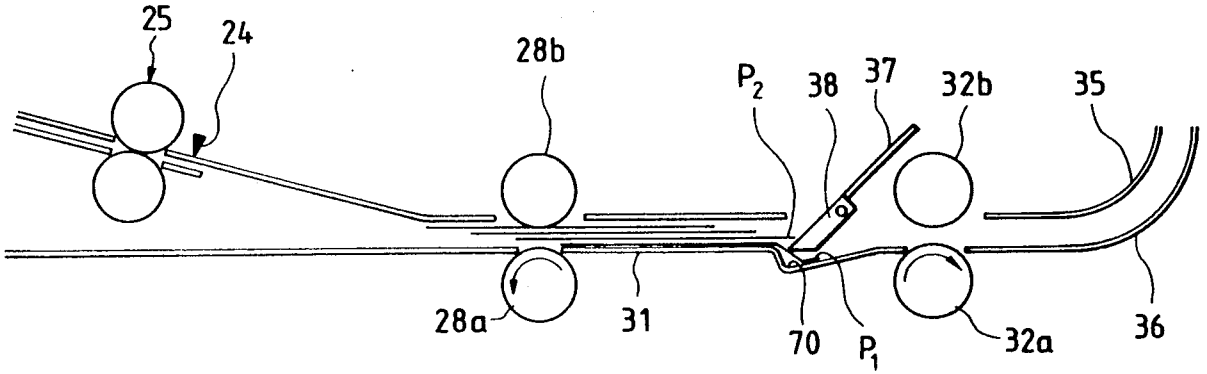
FIGS. 40 and 41 are elevational sectional views of the sheet feeding apparatus showing successive sheet separating and feeding conditions.

This eighth embodiment differs from the first embodiment in the operation of the flapper 38 lowered by the action of the solenoid 38*s* in the step S15 of the flow chart in FIG. 8. That is to say, as shown in FIG. 40, when the flapper 38 is lowered, it urges the first or lowermost sheet $P_1$ down toward the recessed portion 70 and separates this lowermost sheet from the other sheets. Since the bottom surface of the flapper 38 is positioned below the lower guide 31 by the distance $h_1$ as shown in FIG. 36B, the second sheet $P_2$ and other sheets thereon ride on the flapper, thus being separated from the lowermost sheet. Incidentally, the lowermost sheet $P_1$ can advance in a clearance between the flapper 38 and the recessed portion 70 by the aid of its own resiliency.

Figure 41:
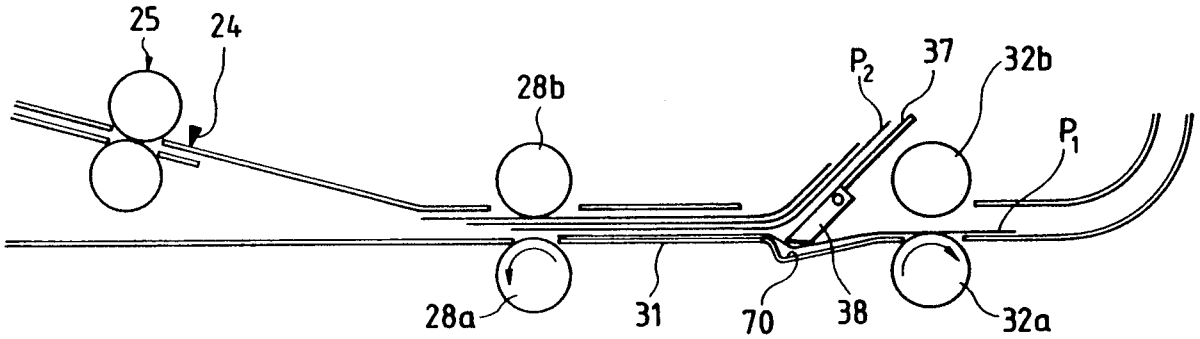

When a time period $t_4$ required for separating the trailing end of the first sheet $P_1$ from the paired rollers 28*a*, 28*b* as shown in FIG. 41 is elapsed, the motor 28*m* is reversed (steps S16, S17). The first sheet $P_1$ is conveyed in the downstream direction by the paired rollers 32*a*, 32*b*, and the second sheet $P_2$ and other sheets thereon is shifted back by the paired rollers 28*a*, 28*b* to return to the original position, and then the motor 28*m* is stopped and the flapper 38 is returned to the position shown in FIG. 39 (steps S18, S19).

Figure 42:
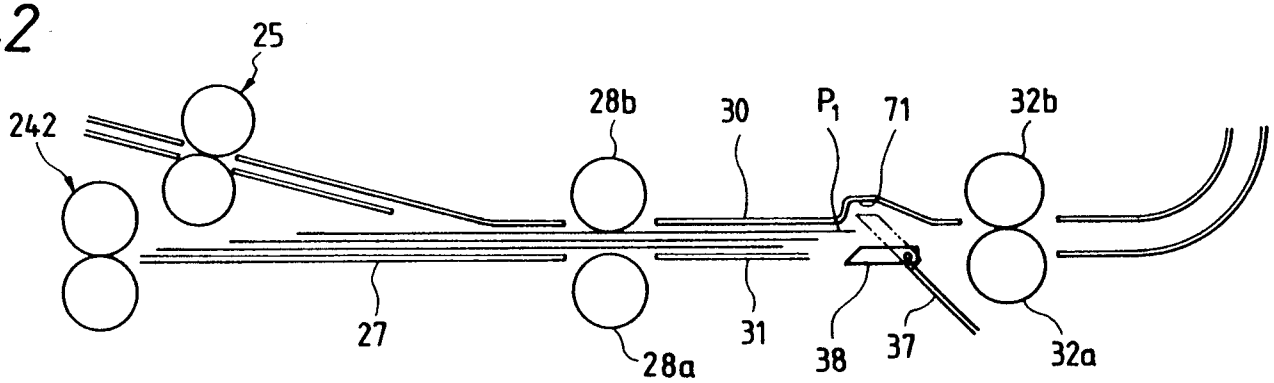
FIG. 42 is an elevational sectional view of a sheet feeding apparatus according to the other embodiment of the present invention.

Incidentally, in the illustrated embodiment, while an example that the sheets are stacked in the stepped fashion so that the lowermost sheet P becomes the firstly fed sheet $P_1$ was explained, by reversing the distance l shown in FIG. 38 to (−l), the uppermost sheet P may become the firstly fed sheet $P_1$. To do so, since the paired rollers 28*a*, 28*b* cannot shift the trailing end of the sheet toward the left of these rollers, as shown in FIG. 42, another pair of rollers 242 are arranged at the left of the lower guide 27, thus shifting back the sheet by the distance (−l) from the paired rollers 28*a*, 28*b*. Further, a recessed portion 71 is formed in the upper guide 30, and the branch guide 37 and flapper 38 are disposed below the recessed portion 71. With this arrangement, the stacked sheets can be re-fed from the uppermost sheet for the image forming operation.

What is claimed is:

1. A sheet feeding apparatus, comprising:

first conveying means for conveying a sheet stack formed in a stepped fashion by offsetting each sheet by a predetermined distance in a predetermined direction toward said predetermined direction or toward an opposite direction;

separating means disposed at a downstream side of said first conveying means in said predetermined direction for separating an outermost sheet from the sheet stack fed out by said first conveying means by sliding between the outermost sheet and other sheets;

second conveying means for conveying the sheet separated by said separating means; and control means for controlling said first conveying means in such a manner that said first conveying means is activated to convey the sheet stack in said predetermined direction and said first conveying means is stopped after the sheet separated by said separating means starts to be conveyed by said second conveying means.

2. A sheet feeding apparatus according to claim 1, wherein said first conveying means conveys said sheet stack while pinching it.

3. A sheet feeding apparatus according to claim 1, wherein said second conveying means conveys the sheet separated by said separating means while pinching it.

4. A sheet feeding apparatus according to claim 1, wherein said separating means guides the outermost sheet and other sheets in the sheet stack being conveyed by said first conveying means into different directions.

5. A sheet feeding apparatus according to claim 1, wherein said separating means includes a separating member having a pointed free end inserted between the outermost sheet and other sheets in the sheet stack being conveyed by said first conveying means to separate the outermost sheet from the other sheets.

6. A sheet feeding apparatus according to claim 5, wherein said free end of said separating member is urged against a surface portion of the outermost sheet which is opposed to the other sheets but does not contact with the other sheets, to separate the outermost sheet from the other sheets in the sheet stack being conveyed by said first conveying means.

7. A sheet feeding apparatus according to claim 6, further including a guide member for guiding a surface of the outer most sheet which does not contact with said separating member, said guide member having. recessed portion for receiving the sheet flexed due to the contact between the sheet and said separating member.

8. A sheet feeding apparatus, comprising:

first conveying means for conveying a sheet stack formed in a stepped fashion by offsetting each sheet by a predetermined distance in a predetermined direction toward said predetermined direction;

separating means disposed at a downstream side of said first conveying means in said predetermined direction for separating an outermost sheet from the sheet stack fed out by said first conveying means by sliding between the outermost sheet and other sheets; and second conveying means for conveying the outermost sheet separated by said separating means.

9. A sheet feeding apparatus according to claim 8 wherein said first conveying means conveys said sheet stack while pinching it.

10. A sheet feeding apparatus according to claim 8, wherein said second conveying means conveys the sheet separated by said separating means while pinching it.

11. A sheet feeding apparatus according to claim 8, wherein said separating means guides the outermost sheet and other sheets in the sheet stack being conveyed by said first conveying means in different directions.

12. A sheet feeding apparatus according to claim 8, wherein said separating means includes a separating member having a pointed free end inserted between the outermost sheet and other sheets in the sheet stack being conveyed by said first conveying means to separate the outermost sheet from the other sheets.

13. A sheet feeding apparatus according to claim 12, wherein said free end of said separating member is urged against a surface portion of the outermost sheet which is opposed to the other sheets but does not contact with the other sheets, to separate the outermost sheet from the other sheets in the sheet stack being conveyed by said first conveying means.

14. A sheet feeding apparatus according to claim 13, further including a guide member for guiding a surface of the sheet which does not contact with said separating member, said guide member having recessed portion for receiving the outer most sheet flexed due to the contact between the sheet and said separating member.

15. A sheet feeding apparatus according to claim 8, further including control means for controlling said first conveying means in such a manner that said first conveying means is activated to convey the sheet stack in said predetermined direction and said first conveying means is activated to convey the other sheets in the reverse direction after the outermost sheet separated by said separating means starts to be conveyed by said second conveying means.

16. A sheet feeding apparatus, comprising:

first conveying means for conveying a sheet stack formed in a stepped fashion by offsetting each sheet by a predetermined distance in a predetermined direction toward said predetermined direction;

second conveying means disposed at a downstream side of said first conveying means in a sheet conveying direction, for conveying the sheet conveyed by said first conveying means; and guiding means disposed between said first and second conveying means and adapted to guide an outermost sheet or other sheets in the sheet stack being conveyed by said first conveying means toward a position where said outermost sheet or said other sheets are not conveyed by said second conveying means, by sliding between the outermost sheet of the sheet stack fed out by said first conveying means and other sheets.

17. A sheet feeding apparatus according to claim 16, wherein said guiding means guides the outermost sheet and the other sheets in the sheet stack being conveyed by said first conveying means in different directions.

18. A sheet feeding apparatus according to claim 16, wherein said guiding means includes a guiding member having a pointed free end inserted between the outermost sheet and the other sheets in the sheet stack being conveyed by said first conveying means to guide the sheet.

19. A sheet feeding apparatus according to claim 18, wherein said guiding member is urged against a surface portion of the outermost sheet which is opposed to the other sheets but does not contact with the other sheets, to guide the sheet.

20. A sheet feeding apparatus according to claim 19, further including a guide member for guiding a surface of the sheet which does not contact with said guiding member, said guide member having a recessed portion for receiving the sheet flexed due to the contact between the outer most sheet and said guiding member.

21. A sheet feeding apparatus according to claim 16, further including control means for controlling said first conveying means in such a manner that said first conveying means is activated to convey the sheet stack in said predetermined direction and said first conveying means is activated to convey the other sheets in the reverse direction after the outermost sheet separated by said guiding means starts to be conveyed by said second conveying means.

22. An image forming system comprising:

containing means for containing sheets;

supplying means for feeding out the sheet contained in said containing means;

image forming means for forming an image on the sheet fed out by said supplying means;

stacking means for stacking the sheets on which the image are formed by said image forming means in a stepped fashion by offsetting each sheet by a predetermined distance in a predetermined direction;

first conveying means for conveying a sheet stack formed in a stepped fashion by offsetting each sheet by the predetermined distance in the predetermined direction by said stacking means toward said predetermined direction;

separating means disposed at a downstream side of said first conveying means in a sheet conveying direction and adapted to be slid between an outermost sheet and other sheets in the sheet stack being conveyed by said first conveying means to separate said outermost sheet from said other sheets; and second conveying means for conveying the outermost sheet separated by said separating means to said image forming means.

23. A sheet feeding apparatus, comprising:

first conveying means for conveying a sheet stack formed in a stepped fashion by offsetting each sheet by a predetermined distance in a predetermined direction toward said predetermined direction;

separating means disposed at a downstream side of said first conveying means in said predetermined direction for separating an outermost sheet from the sheet stack fed out by said first conveying means by sliding between the outermost sheet and other sheets;

second conveying means for conveying the sheet separated by said separating means; and image forming means for forming an image on the sheet conveyed by said second conveying means.

24. A sheet feeding apparatus, comprising:

conveying means for conveying bundle of sheets stacked with shifting predetermined length in predetermined direction in one direction or other direction;

separating means disposed upstream of said conveying direction, for separating an outermost sheet from other sheets among the sheets conveyed by said conveying means by sliding between the outermost sheet and other sheets;

nipping means for nipping the other sheets separated by said separating means; and control means for controlling said conveying means so that the sheet bundle is conveyed in the other direction by said conveying means, the other sheets separated by said separating means are nipped by said nipping means, and the outermost sheet not nipped is conveyed in the one direction by said conveying means.

25. A sheet feeding apparatus according to claim 24, wherein said conveying means conveys said sheet stack by nipping

26. A sheet feeding apparatus according to claim 24, wherein said nipping means conveys the sheet separated by said separating means by nipping it.

27. A sheet feeding apparatus according to claim 24, wherein said separating means guides the outermost sheet and other sheets conveyed by said conveying means in different directions.

28. A sheet feeding apparatus according to claim 24, wherein said separating means separates the sheets by abutting an area not in contact with the other sheets of the sheet surface opposed to the other sheets.

* * * * *

UNITED STATES PATENT AND TRADEMARK OFFICE

CERTIFICATE OF CORRECTION

PATENT NO. : 5,305,995 
DATED : April 26, 1994
INVENTOR(S) : HISAO NAKAJIMA, ET AL.

It is certified that error appears in the above-indentified patent and that said Letters Patent is hereby corrected as shown below:

On title page, item [57] Abstract
line 12, "and" should read --and a--.

Column 1,
line 19, "Conventional" should read --In conventional--.

Column 4,
line 65, "both-surface" should read --two-sided--.

Column 5,
line 46, "FIG. 38," should read --FIG. 3B,--.

Column 6,
line 18, "been" should be deleted.

Column 7,
line 12, "been" should be deleted; and
line 35, "been" should be deleted.

UNITED STATES PATENT AND TRADEMARK OFFICE

CERTIFICATE OF CORRECTION

PATENT NO. : 5,305,995

DATED : April 26, 1994

INVENTOR(S) : HISAO NAKAJIMA, ET AL.

It is certified that error appears in the above-indentified patent and that said Letters Patent is hereby corrected as shown below:

Column 12,
line 16, "distance (" should read --distance l--; and
line 26, "a" should read --an--.

Column 14,
line 21, "having." should read --having a--; and
line 64, "having" should read --having a--.

Column 16,
line 53, "nipping" should read --nipping it.--.

Signed and Sealed this

Eighteenth Day of October, 1994

Bruce Lehman

*Attest:*

BRUCE LEHMAN

*Attesting Officer*

*Commissioner of Patents and Trademarks*